US012006671B2

(12) United States Patent
Macsay

(10) Patent No.: US 12,006,671 B2
(45) Date of Patent: Jun. 11, 2024

(54) WAND WITH BOOST AND MODE SELECTIONS

(71) Applicant: Moen Incorporated, North Olmsted, OH (US)

(72) Inventor: Steven M. Macsay, Strongsville, OH (US)

(73) Assignee: Fortune Brands Water Innovations LLC, North Olmsted, OH (US)

( * ) Notice: Subject to any disclaimer, the term of this patent is extended or adjusted under 35 U.S.C. 154(b) by 567 days.

(21) Appl. No.: 16/708,603

(22) Filed: Dec. 10, 2019

(65) Prior Publication Data

US 2020/0181892 A1 Jun. 11, 2020

Related U.S. Application Data

(60) Provisional application No. 62/777,974, filed on Dec. 11, 2018.

(51) Int. Cl.
*E03C 1/04* (2006.01)

(52) U.S. Cl.
CPC ..... *E03C 1/0405* (2013.01)

(58) Field of Classification Search
CPC ..... E03C 1/0405; E03C 2001/0415
See application file for complete search history.

(56) References Cited

U.S. PATENT DOCUMENTS 6,016,830 A 1/2000 Niakan et al.
6,085,790 A 7/2000 Humpert et al.
6,938,837 B2 9/2005 Nelson et al.
6,978,795 B2 12/2005 Perrin
7,070,125 B2 7/2006 Williams et al.
7,252,248 B2 8/2007 Cutler
7,322,535 B2 1/2008 Erdely
7,380,731 B1 6/2008 Hsu
7,494,074 B2 2/2009 Benstead
7,607,588 B2 10/2009 Nobili
7,748,406 B2 7/2010 Pilatowicz et al.
7,854,401 B2 12/2010 Malek
7,871,020 B2 1/2011 Nelson et al.
7,909,269 B2 3/2011 Erickson et al.
7,919,877 B2 4/2011 Shimizu et al.
(Continued)

*Primary Examiner* — Qingzhang Zhou
*Assistant Examiner* — Joel Zhou
(74) *Attorney, Agent, or Firm* — Calfee, Halter & Griswold LLP

(57) ABSTRACT

A wand with boost and mode selections having a high flow capacity and a compact size is provided. The wand comprises a shell, a waterway, and a face module. The waterway includes boost and mode modules. The boost module includes fixed and movable boost sub-modules. The mode module includes fixed and movable mode sub-modules. The movable boost sub-module and the movable mode sub-module are operable to move in a generally longitudinal and circumferential direction, respectively. A first flow passage of the fixed boost sub-module, a second flow passage of the movable boost sub-module, a third flow passage and flow openings of the movable mode sub-module, and first and second outlet passages of the fixed mode sub-module extend in and a flow of water therethrough extends in a generally longitudinal direction. A ratio of a flow coefficient of the wand to a volume of the shell is greater than approximately 0.125.

20 Claims, 17 Drawing Sheets

(56) References Cited

U.S. PATENT DOCUMENTS

| | | | |
|---|---|---|---|
| 7,956,480 | B2 | 6/2011 | Onodera et al. |
| 8,201,758 | B2 | 6/2012 | Cheng |
| 8,573,512 | B2 | 11/2013 | Hu |
| 8,783,288 | B2 | 7/2014 | Lin |
| 8,800,893 | B2 | 8/2014 | Malek et al. |
| 8,960,569 | B2 | 2/2015 | Pedersen |
| 9,067,222 | B2 | 6/2015 | Gransow et al. |
| 9,068,329 | B2 | 6/2015 | Gransow et al. |
| 9,175,459 | B2 | 11/2015 | Zhang et al. |
| 9,259,743 | B2 | 2/2016 | Hanna et al. |
| 9,259,747 | B2 | 2/2016 | Erickson |
| 9,441,750 | B2 | 9/2016 | Huck et al. |
| 9,545,639 | B2 | 1/2017 | Meehan et al. |
| 9,556,597 | B2 | 1/2017 | Bares et al. |
| 9,611,943 | B2 | 4/2017 | Chen et al. |
| 9,649,645 | B2 | 5/2017 | Erickson |
| 9,656,280 | B2 * | 5/2017 | Pitsch ..... B05B 1/169 |
| 9,707,572 | B2 | 7/2017 | Erickson et al. |
| 9,714,503 | B2 | 7/2017 | Song et al. |
| 9,757,740 | B2 | 9/2017 | Erickson et al. |
| 9,803,344 | B2 | 10/2017 | Carpenter-Crawford |
| 9,962,718 | B2 | 5/2018 | Vogel et al. |
| 10,058,878 | B2 | 8/2018 | Hu et al. |
| 10,086,390 | B2 | 10/2018 | Erickson |
| 10,106,965 | B2 | 10/2018 | Chiu et al. |
| 10,124,349 | B2 | 11/2018 | Erickson et al. |
| 10,125,901 | B2 | 11/2018 | Davidson et al. |
| 2002/0185553 | A1 | 12/2002 | Benstead et al. |
| 2005/0189438 | A1 | 9/2005 | Bosio |
| 2007/0295837 | A1 | 12/2007 | Stork et al. |
| 2010/0301144 | A1 | 12/2010 | Shepler |
| 2012/0153050 | A1 * | 6/2012 | Bosio ..... E03C 1/0404 239/525 |
| 2013/0075500 | A1 | 3/2013 | Sithamparanathan |
| 2013/0193237 | A1 | 8/2013 | Erickson |
| 2013/0214064 | A1 | 8/2013 | Vorel |
| 2014/0150896 | A1 | 6/2014 | Guan et al. |
| 2016/0160481 | A1 | 6/2016 | Lev |
| 2016/0228891 | A1 | 8/2016 | Rosko et al. |
| 2017/0058496 | A1 | 3/2017 | Chiu et al. |
| 2017/0059050 | A1 | 3/2017 | Chiu et al. |
| 2017/0073943 | A1 | 3/2017 | Stoelzel et al. |
| 2017/0106381 | A1 | 4/2017 | Erickson |
| 2017/0173601 | A1 | 6/2017 | Mazz et al. |
| 2017/0252755 | A1 | 9/2017 | Pitsch et al. |
| 2017/0298600 | A1 | 10/2017 | Rosko et al. |
| 2017/0333920 | A1 | 11/2017 | Erickson et al. |
| 2018/0071755 | A1 | 3/2018 | Romero |
| 2018/0141068 | A1 * | 5/2018 | Chiu ..... E03C 1/10 |
| 2018/0250693 | A1 | 9/2018 | Vogel et al. |
| 2019/0071850 | A1 | 3/2019 | Waddell |
| 2019/0085538 | A1 | 3/2019 | Chang et al. |

* cited by examiner

WAND WITH BOOST AND MODE SELECTIONS

CROSS-REFERENCE TO RELATED APPLICATION

This application claims the benefit of U.S. Provisional Application No. 62/777,974, filed Dec. 11, 2018, the entire disclosure of which is hereby incorporated by reference.

FIELD

The present invention relates generally to a wand with boost and mode selections, and, more particularly, to a wand with boost and mode selections having a high flow capacity and a compact size.

BACKGROUND

Wands with boost and mode selections are known. Increasing the flow capacity of the wands results in increasing the size of the wands. Conversely, decreasing the size of the wands results in decreasing the flow capacity of the wands. Wands with a high flow capacity and a compact size are desired.

SUMMARY

The present invention provides a wand with boost and mode selections having a high flow capacity and a compact size.

In an exemplary embodiment, the wand comprises a shell, a waterway, and a face module. The shell is operable to pull away from a faucet. The waterway is operable to be substantially disposed in the shell. The waterway includes a boost module and a mode module. The boost module includes a fixed boost sub-module and a movable boost sub-module. The mode module includes a fixed mode sub-module and a movable mode sub-module. The fixed boost sub-module includes an inlet region and a first flow passage. The inlet region is operable to connect to a water hose. The first flow passage is operable to fluidly communicate with the water hose. The movable boost sub-module includes a second flow passage. The second flow passage is operable to fluidly communicate with the first flow passage. The movable mode sub-module includes a third flow passage and a plurality of flow openings. The third flow passage is operable to fluidly communicate with the second flow passage. The plurality of flow openings is operable to fluidly communicate with the third flow passage. The fixed mode sub-module includes a plurality of first outlet passages and a plurality of second outlet passages. The plurality of first outlet passages is operable to fluidly communicate with the plurality of flow openings. The plurality of second outlet passages is operable to fluidly communicate with the plurality of flow openings. The face module includes a first outlet and a second outlet. The first outlet is operable to fluidly communicate with the plurality of first outlet passages and deliver water from the face module in a first form. The second outlet is operable to fluidly communicate with the plurality of second outlet passages and deliver water from the face module in a second form. The movable boost sub-module is operable to move in a generally longitudinal direction. The movable mode sub-module is operable to move in a generally circumferential direction.

In an exemplary embodiment, the wand comprises a shell, a waterway, and a face module. The shell is operable to pull away from a faucet. The waterway is operable to be substantially disposed in the shell. The waterway includes a boost module and a mode module. The boost module includes a fixed boost sub-module and a movable boost sub-module. The mode module includes a fixed mode sub-module and a movable mode sub-module. The fixed boost sub-module includes an inlet region and a first flow passage. The inlet region is operable to connect to a water hose. The first flow passage is operable to fluidly communicate with the water hose. The movable boost sub-module includes a second flow passage. The second flow passage is operable to fluidly communicate with the first flow passage. The movable mode sub-module includes a third flow passage and a plurality of flow openings. The third flow passage is operable to fluidly communicate with the second flow passage. The plurality of flow openings is operable to fluidly communicate with the third flow passage. The fixed mode sub-module includes a plurality of first outlet passages and a plurality of second outlet passages. The plurality of first outlet passages is operable to fluidly communicate with the plurality of flow openings. The plurality of second outlet passages is operable to fluidly communicate with the plurality of flow openings. The face module includes a first outlet and a second outlet. The first outlet is operable to fluidly communicate with the plurality of first outlet passages and deliver water from the face module in a first form. The second outlet is operable to fluidly communicate with the plurality of second outlet passages and deliver water from the face module in a second form. The first flow passage, the second flow passage, the third flow passage, the plurality of flow openings, the plurality of first outlet passages, and the plurality of second outlet passages extend in a generally longitudinal direction. The flow of water through the first flow passage, the second flow passage, the third flow passage, the plurality of flow openings, the plurality of first outlet passages, and the plurality of second outlet passages extends in a generally longitudinal direction.

In an exemplary embodiment, the wand comprises a shell, a waterway, and a face module. The shell is operable to pull away from a faucet. The waterway is operable to be substantially disposed in the shell. The waterway includes a boost module and a mode module. The boost module includes a fixed boost sub-module and a movable boost sub-module. The mode module includes a fixed mode sub-module and a movable mode sub-module. The fixed boost sub-module includes an inlet region and a first flow passage. The inlet region is operable to connect to a water hose. The first flow passage is operable to fluidly communicate with the water hose. The movable boost sub-module includes a second flow passage. The second flow passage is operable to fluidly communicate with the first flow passage. The movable mode sub-module includes a third flow passage and a plurality of flow openings. The third flow passage is operable to fluidly communicate with the second flow passage. The plurality of flow openings is operable to fluidly communicate with the third flow passage. The fixed mode sub-module includes a plurality of first outlet passages and a plurality of second outlet passages. The plurality of first outlet passages is operable to fluidly communicate with the plurality of flow openings. The plurality of second outlet passages is operable to fluidly communicate with the plurality of flow openings. The face module includes a first outlet and a second outlet. The first outlet is operable to fluidly communicate with the plurality of first outlet passages and deliver water from the face module in a first form. The second outlet is operable to fluidly communicate with the plurality of second outlet passages and deliver water from the face module in a second form. A ratio of a flow coefficient of the wand to a volume of the shell is greater than approximately 0.125.

BRIEF DESCRIPTION OF THE DRAWINGS

-FIG. 1*a* is an assembled front left perspective view, FIG. 1*b* is an assembled rear right perspective view, FIG. 1*c* is an assembled front view, and FIG. 1*d* is an assembled right side view;

*-FIG. 2*a* is an assembled perspective view, FIG. 2*b* is an assembled top view, FIG. 2*c* is an assembled side view, and FIG. 2*d* is an assembled end view;

*-FIG. 4*a* is a cross-sectional perspective view, and FIG. 4*b* is a cross-sectional side view;

*-FIG. 5*a* is a cross-sectional side view showing no flow, FIG. 5*b* is a cross-sectional side view showing normal (spray) flow, and FIG. 5*c* is a cross-sectional side view showing boost (spray) flow;

*-FIG. 6*a* is a cross-sectional perspective view showing stream flow, and FIG. 6*b* is a cross-sectional perspective view showing spray flow.

DETAILED DESCRIPTION

Figure 1A:
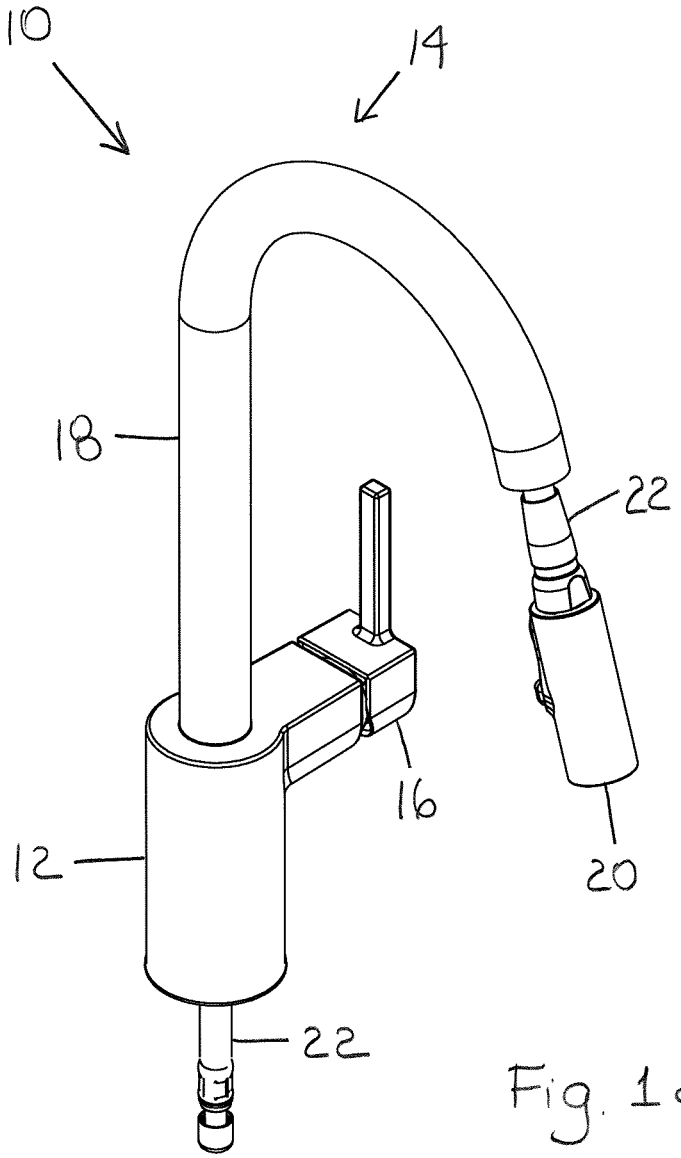
FIGS. 1*a*-1*d* are views of a faucet with a wand according to an exemplary embodiment of the present invention
Figure 1B:
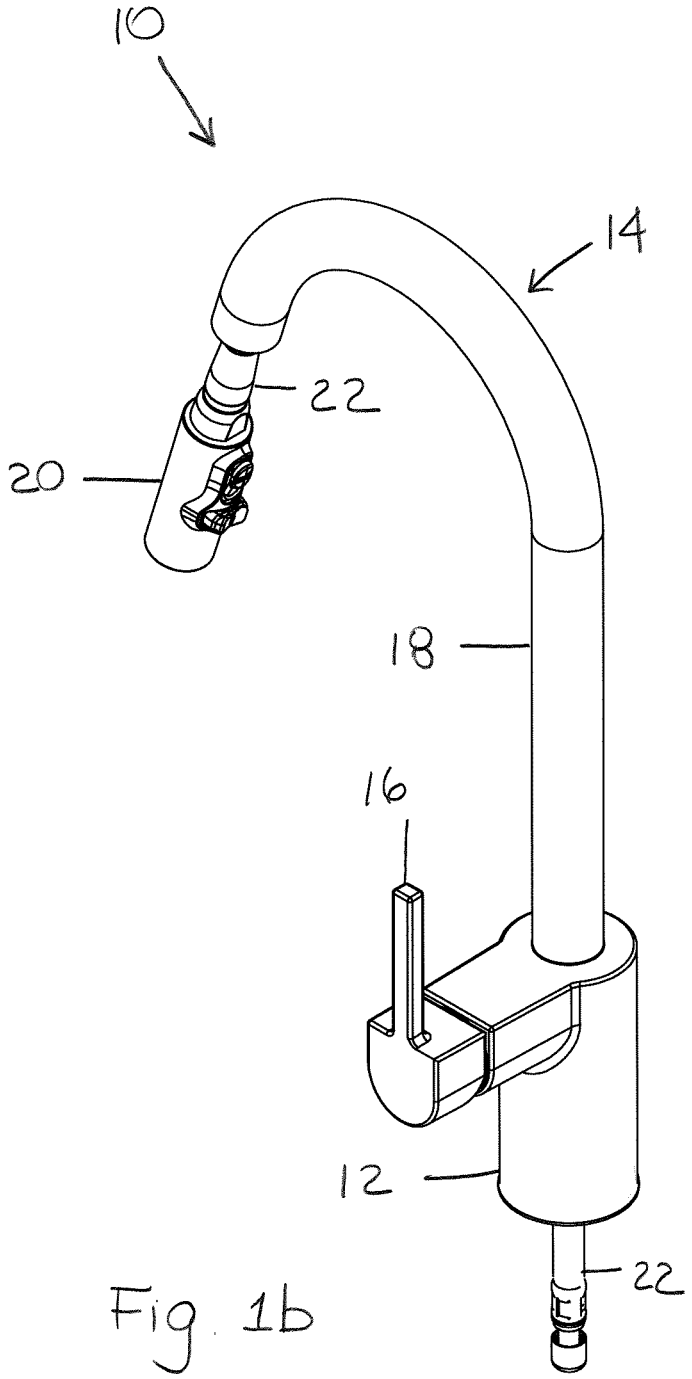
Figure 1C:
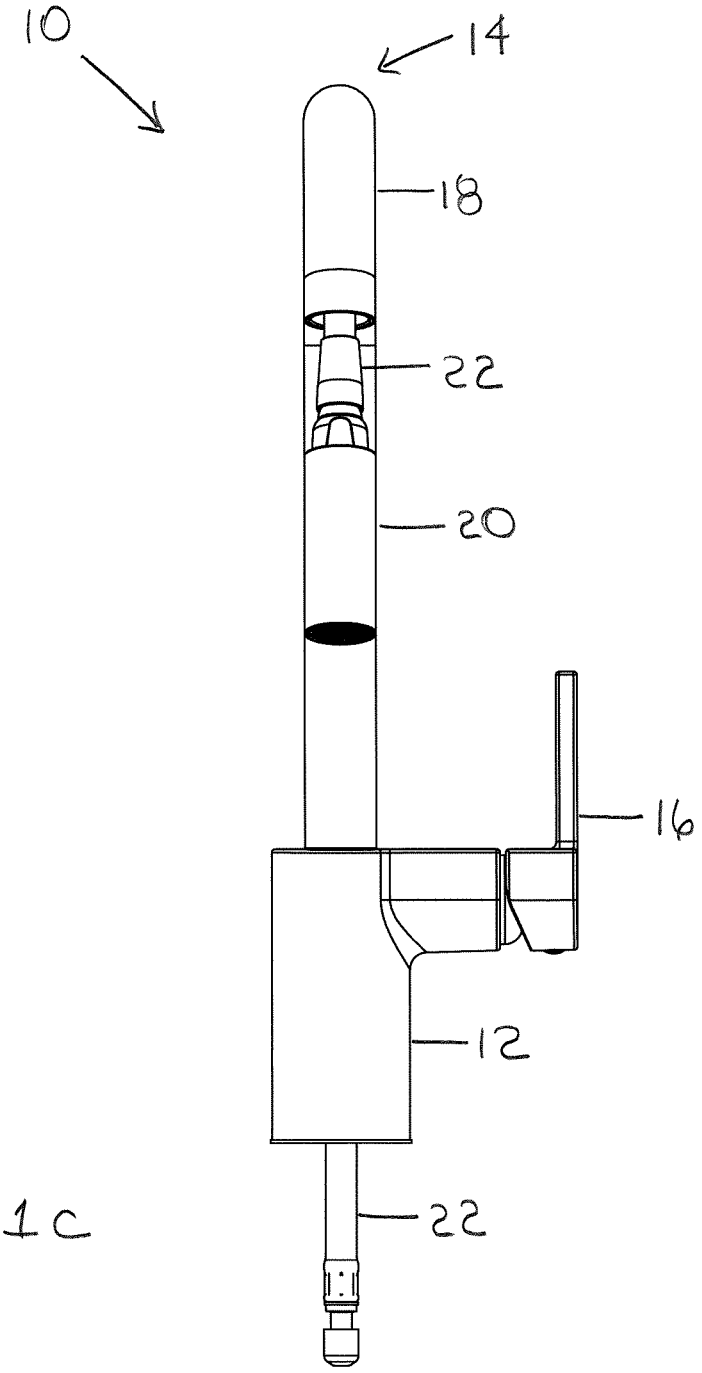
Figure 1D:
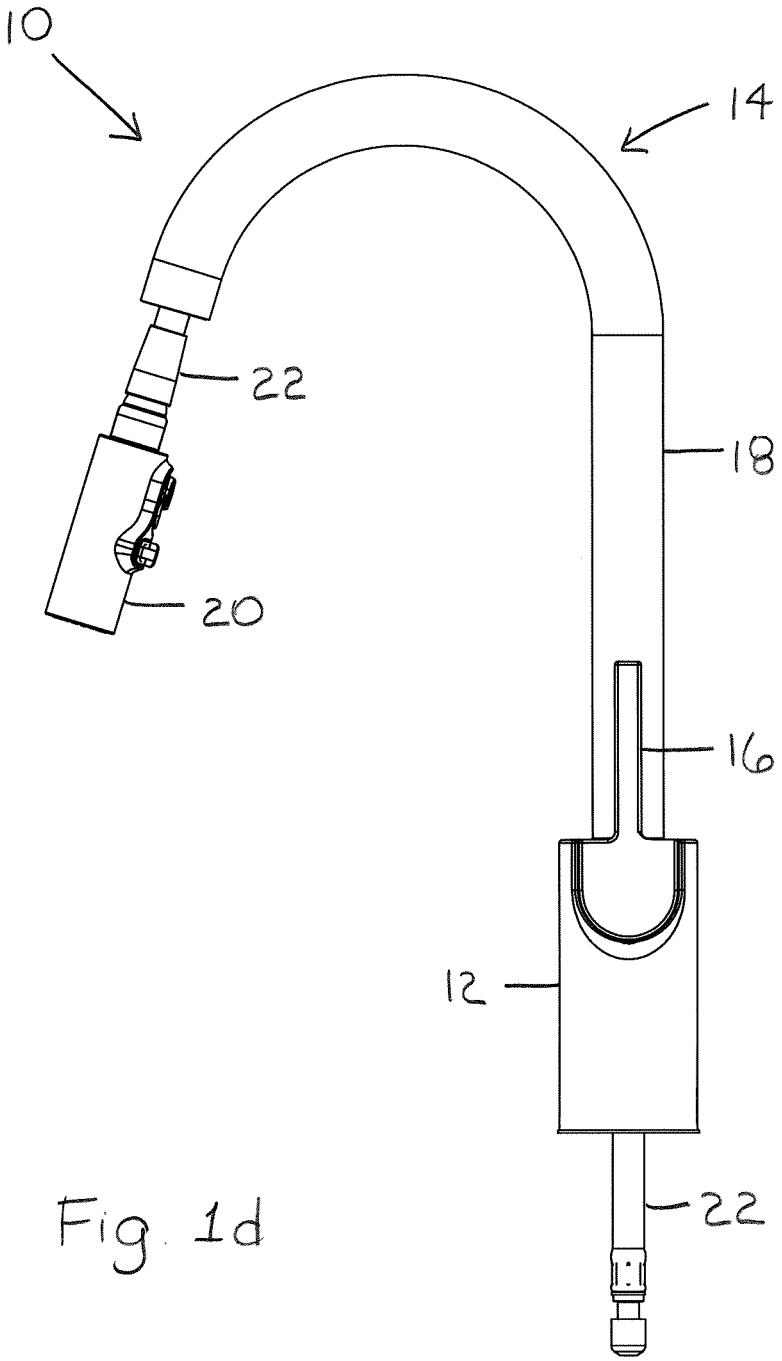
Figure 2B:
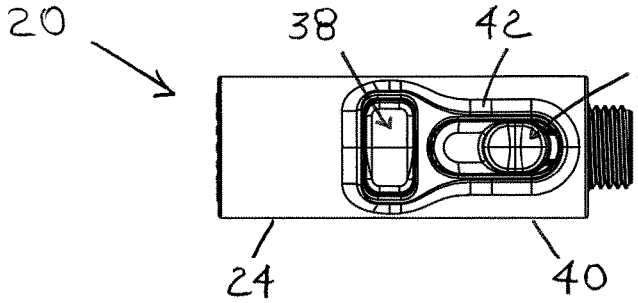
FIGS. 2*a*-2*d* are views of the wand of FIGS. 1*a*-1*d
Figure 2D:
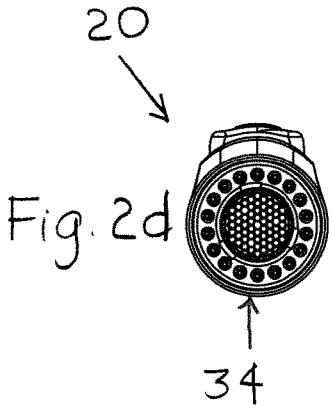
Figure 2C:
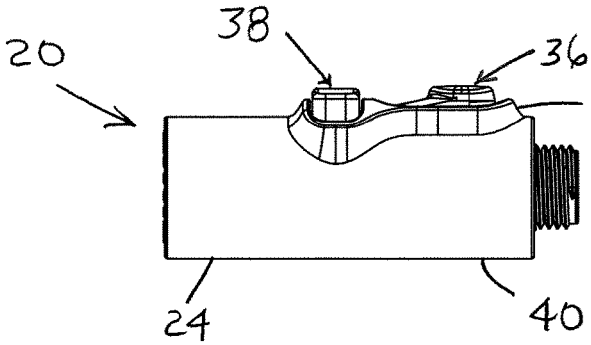
Figure 2A:
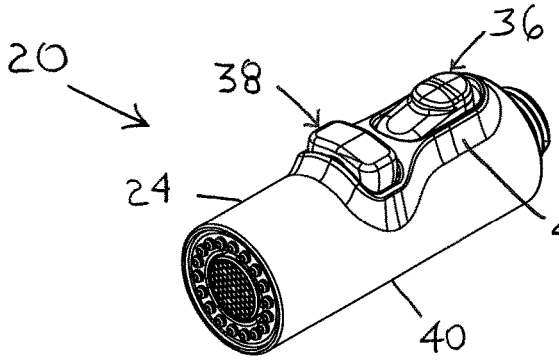

The present invention provides a wand with boost and mode selections having a high flow capacity and a compact size.

An exemplary embodiment of a faucet 10 of the present invention is shown in detail in FIGS. 1*a*-1*d*. In the illustrated embodiment, the faucet 10 includes a hub 12, a spout 14, and a handle 16. The spout 14 includes a receptor 18 and a wand 20. A base of the hub 12 is connected (either directly or indirectly) to a mounting surface (such as a counter or sink). An upstream end of the receptor 18 is connected to the hub 12. In the illustrated embodiment, the upstream end of the receptor 18 is connected to a top of the hub 12. In an exemplary embodiment, the upstream end of the receptor 18 is connected to a side of the hub 12. An upstream end of the wand 20 is mounted in a downstream end of the receptor 18. The upstream end of the wand 20 is connected to a wand hose 22. The wand hose 22 extends through the receptor 18 and the hub 12. The wand 20 is operable to pull away from the receptor 18. The wand 20 is operable to deliver water from the faucet 10. The handle 16 is connected to the hub 12. In the illustrated embodiment, the handle 16 is connected to the side of the hub 12. In an exemplary embodiment, the handle 16 is connected to the top of the hub 12. The handle 16 is operable to move relative to the hub 12.

An exemplary embodiment of the wand 20 of the present invention is shown in detail in FIGS. 1*a*-6*b*. In the illustrated embodiment, the wand 20 includes a shell 24 and a waterway 26. The shell 24 is operable to pull away from the receptor 18. The waterway 26 is separately formed from the shell 24. The waterway 26 is substantially disposed within the shell 24. The waterway 26 includes a boost module 28, a mode module 30, and a shaft 32. The wand 20 further includes a face module 34, a boost actuator module 36, and a mode actuator module 38.

An exemplary embodiment of the shell 24 is shown in detail in FIGS. 1*a*-6*b*. In the illustrated embodiment, the shell 24 includes an upstream end, a mid-section, and a downstream end. The shell 24 includes an outer surface and an inner surface. The shell 24 includes a generally cylindrical portion 40 extending from the upstream end to the downstream end. The shell 24 includes a raised portion 42 extending outwardly from the outer surface in the upstream end and the mid-section. The shell 24 includes a boost toggle opening 44 and a mode toggle opening 46 extending through the raised portion 42 and the generally cylindrical portion 40. The boost toggle opening 44 is generally oblong shaped and extends in a longitudinal direction in the downstream end. The mode toggle opening 46 is generally oblong shaped and extends in a circumferential direction in the mid-section. The shell 24 includes a plurality of boost pins 48 extending into the boost toggle opening 44. In the illustrated embodiment, the plurality of boost pins 48 includes two boost pins 48. The shell 24 includes a plurality of mode saddles 50 extending into the mode toggle opening 46. In the illustrated embodiment, the plurality of mode saddles 50 includes two mode saddles 50. The shell 24 includes a plurality of shell slots 52 extending longitudinally in the inner surface from the upstream end to the mid-section. In the illustrated embodiment, the plurality of shell slots 52 includes two shell slots 52. The shell 24 includes threads 54 in the inner surface of the downstream end.

Figures 1, 3A:
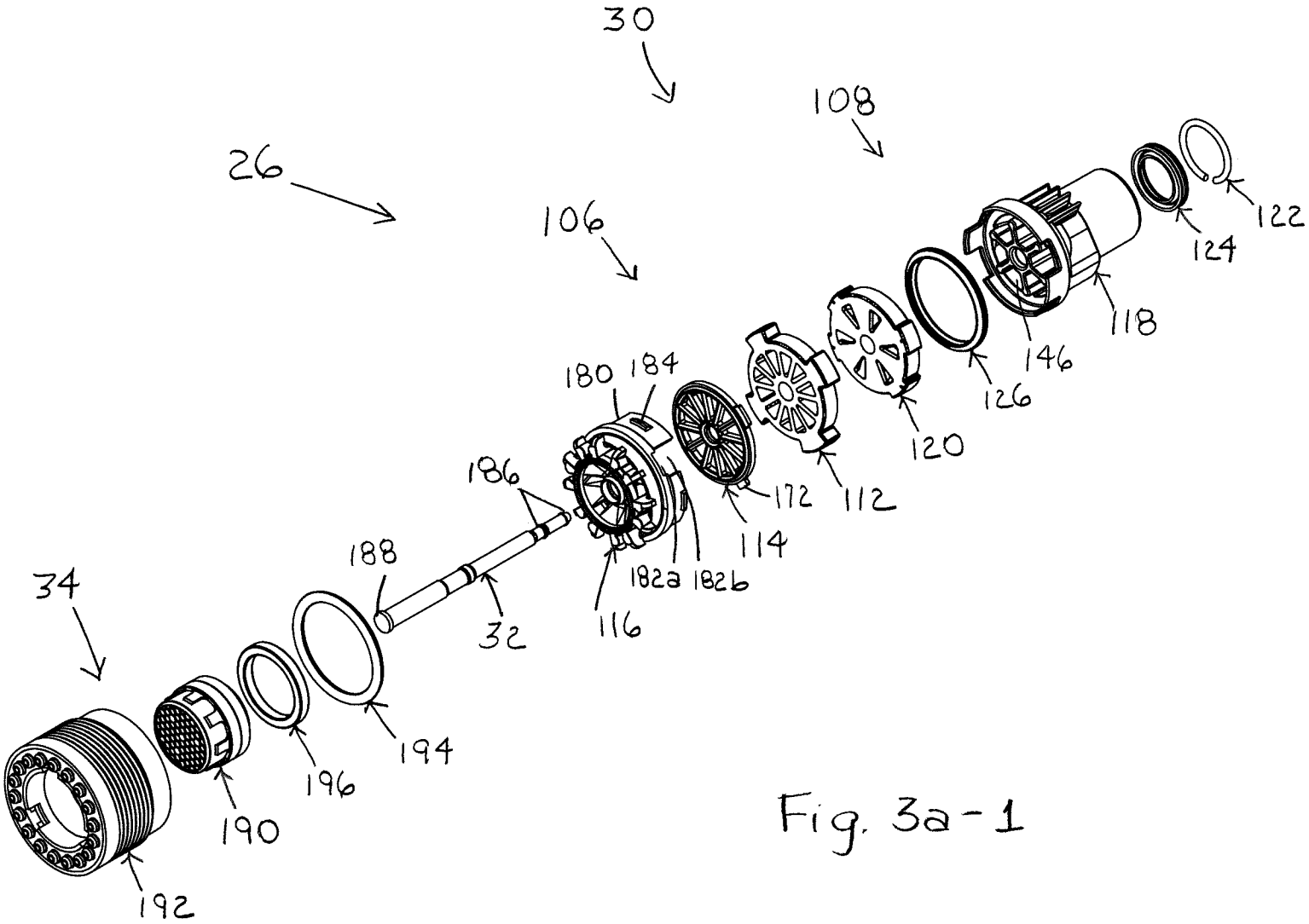
FIGS. 3*a*-1-3*b*-2 are views of the wand of FIGS. 1*a*-1*d*-FIGS. 3*a*-1 and 3*a*-2 collectively are an exploded perspective view, and FIGS. 3*b*-1 and 3*b*-2 collectively are a cross-sectional exploded perspective view.
Figures 2, 3A:
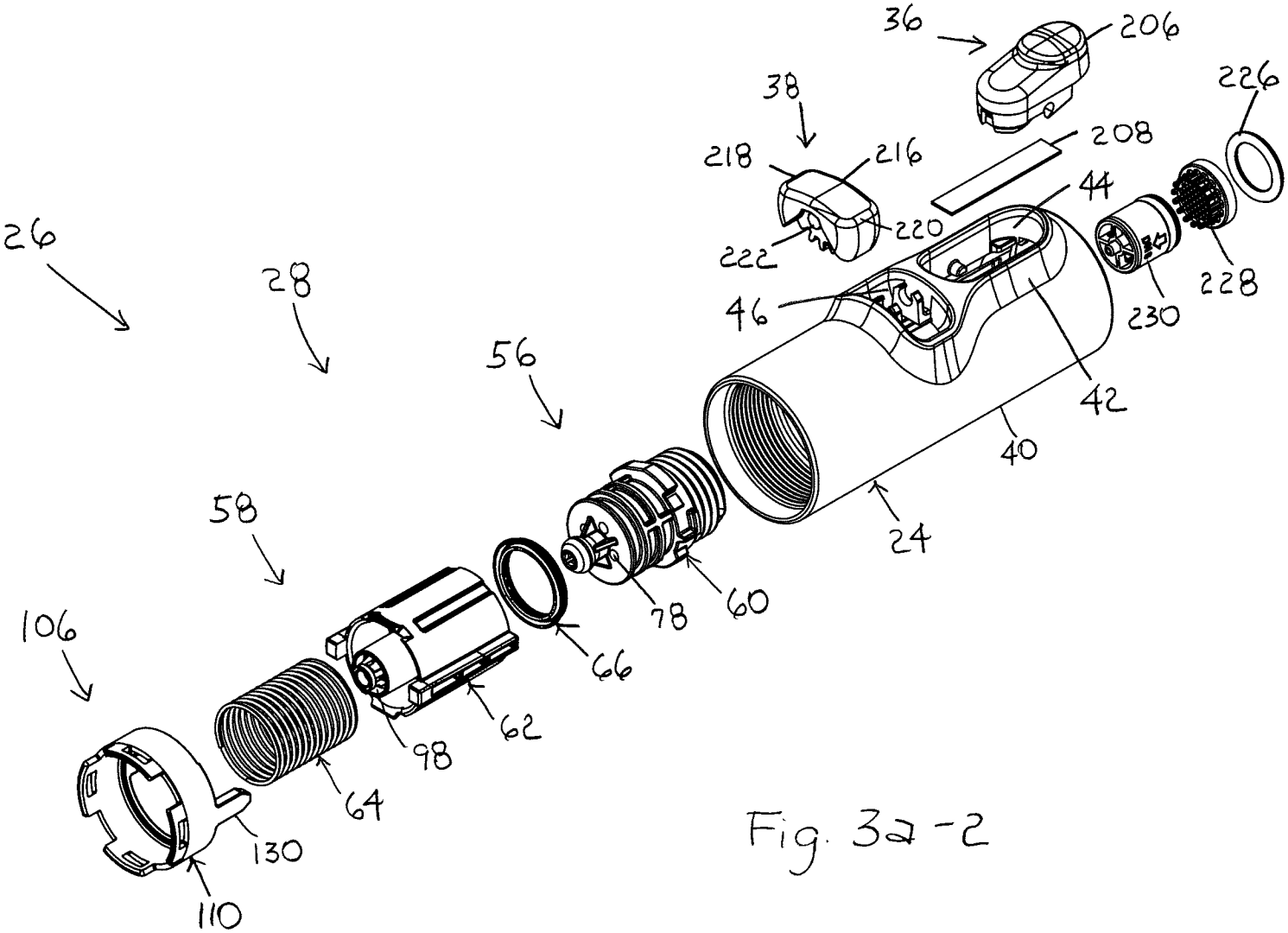
Figures 1, 36:
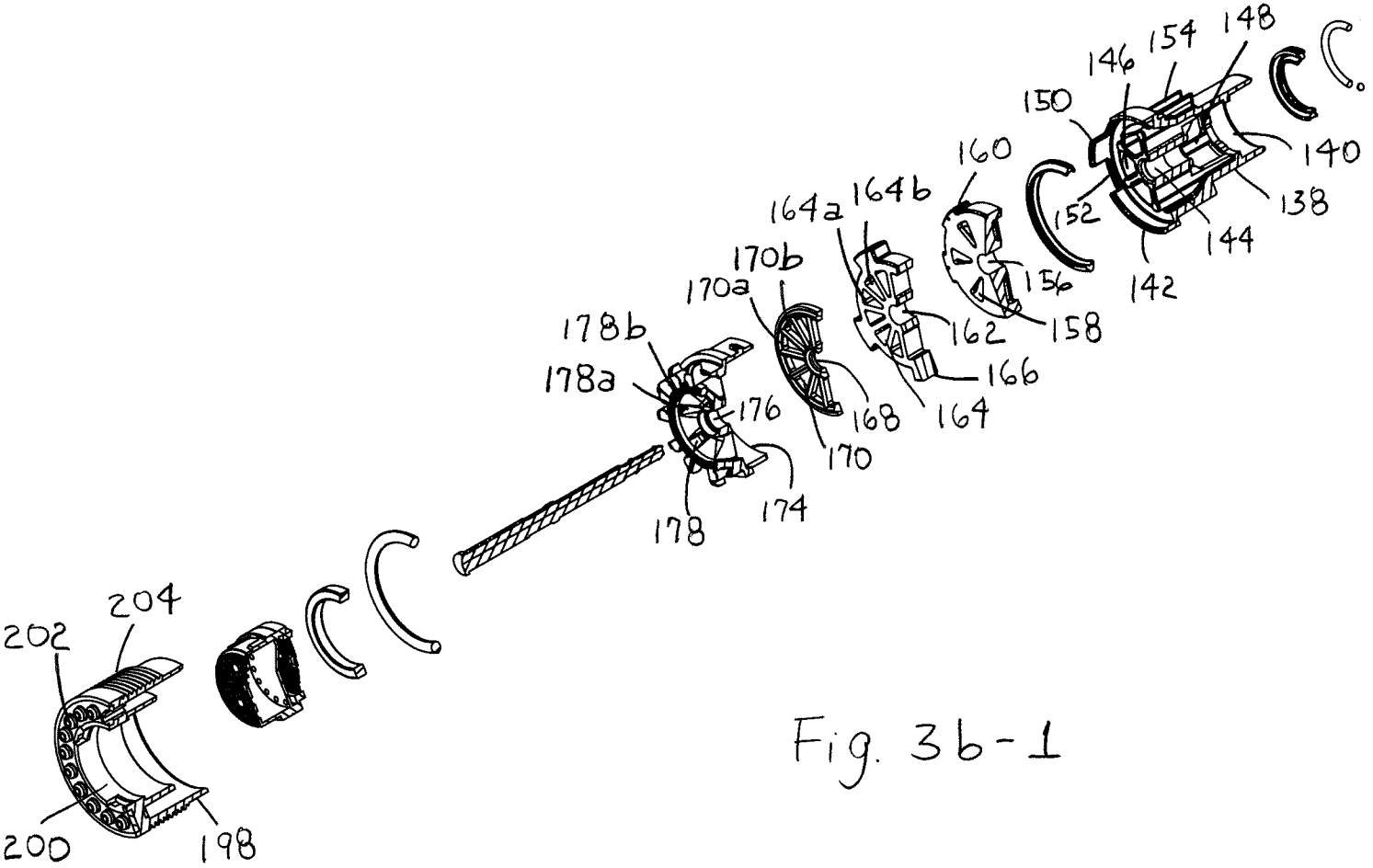
Figures 2, 3B:
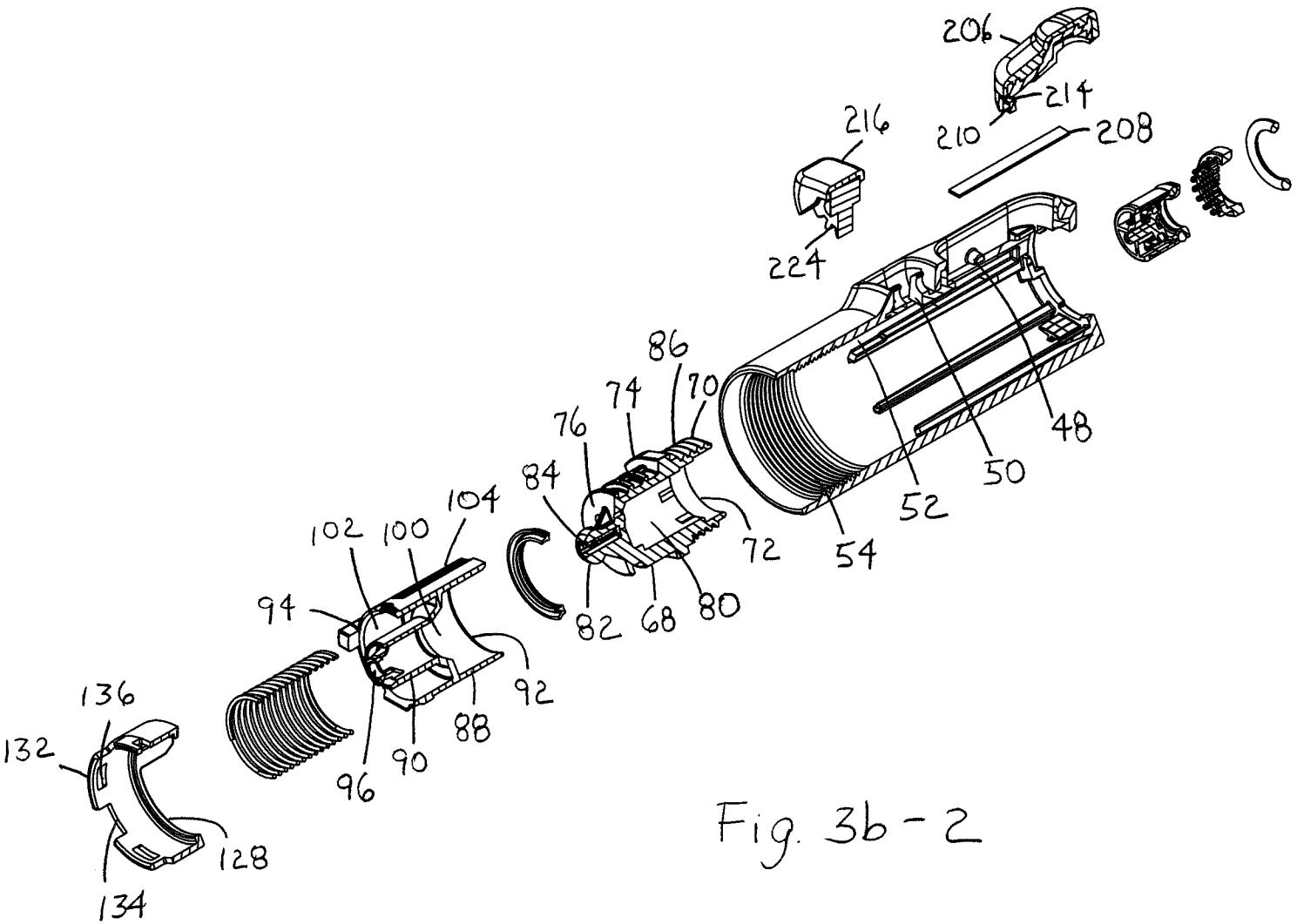
Figure 4A:
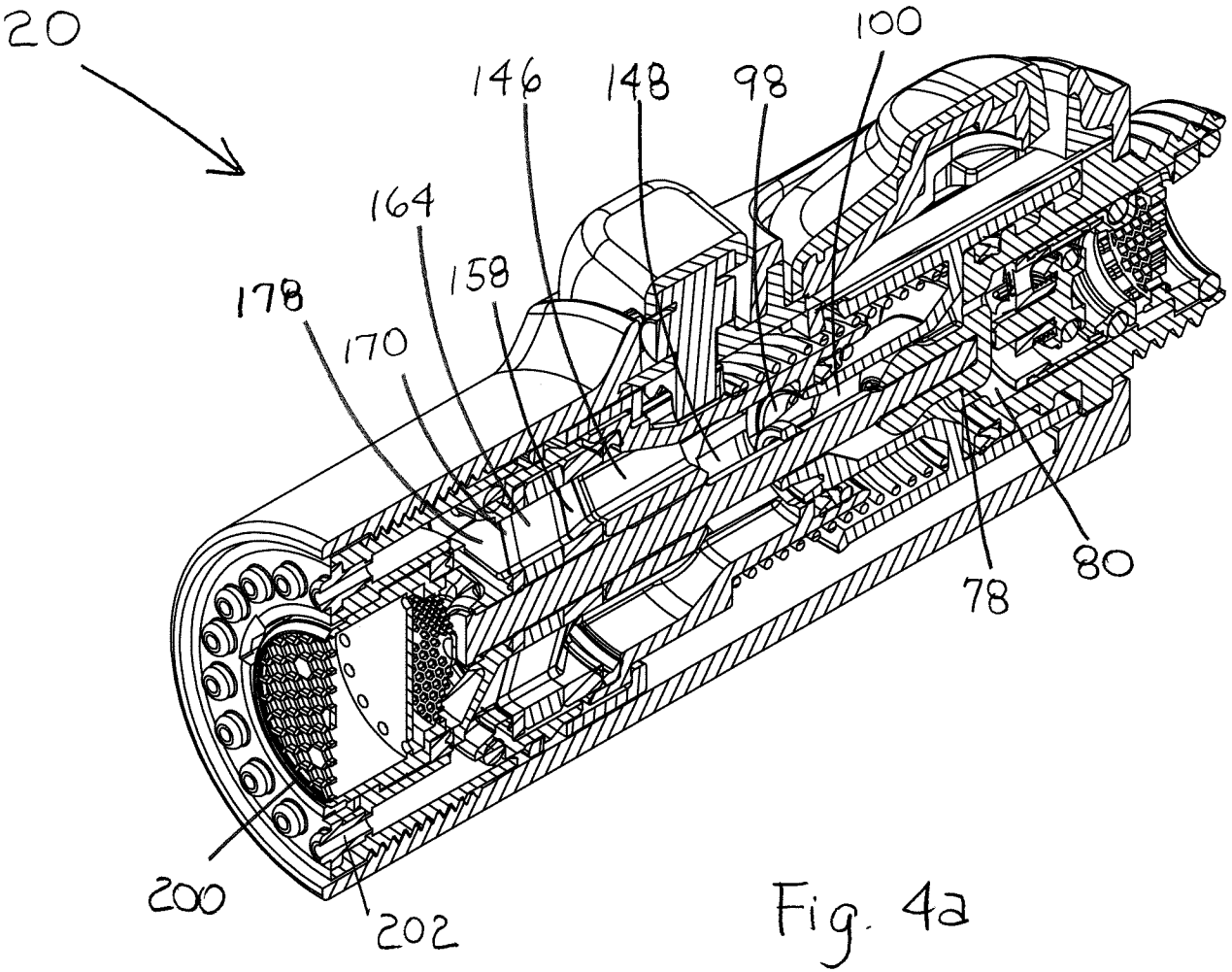
FIGS. 4*a*-4*b* are views of the wand of FIGS. 1*a*-1*d
Figure 4B:
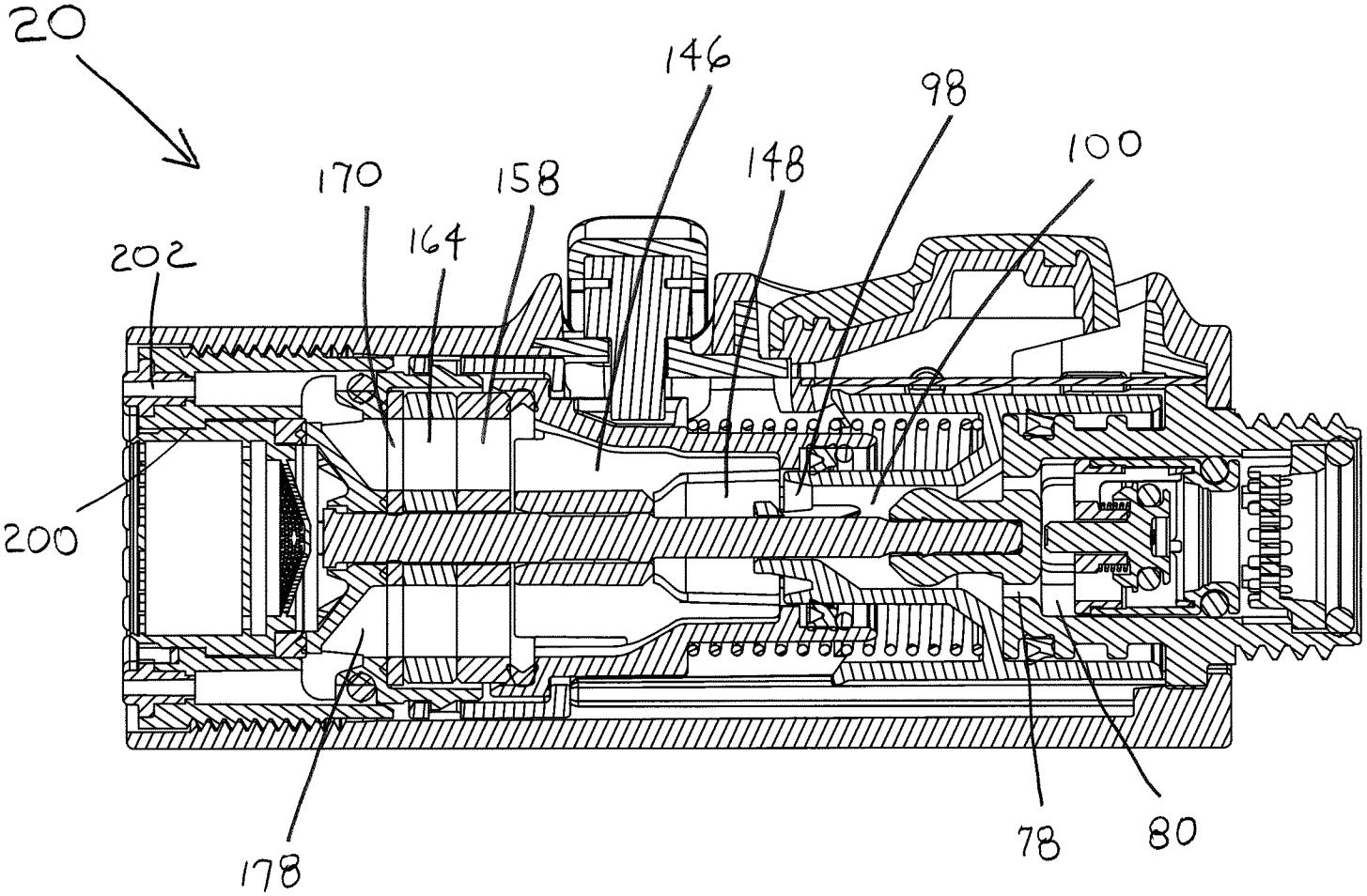
Figure 6A:
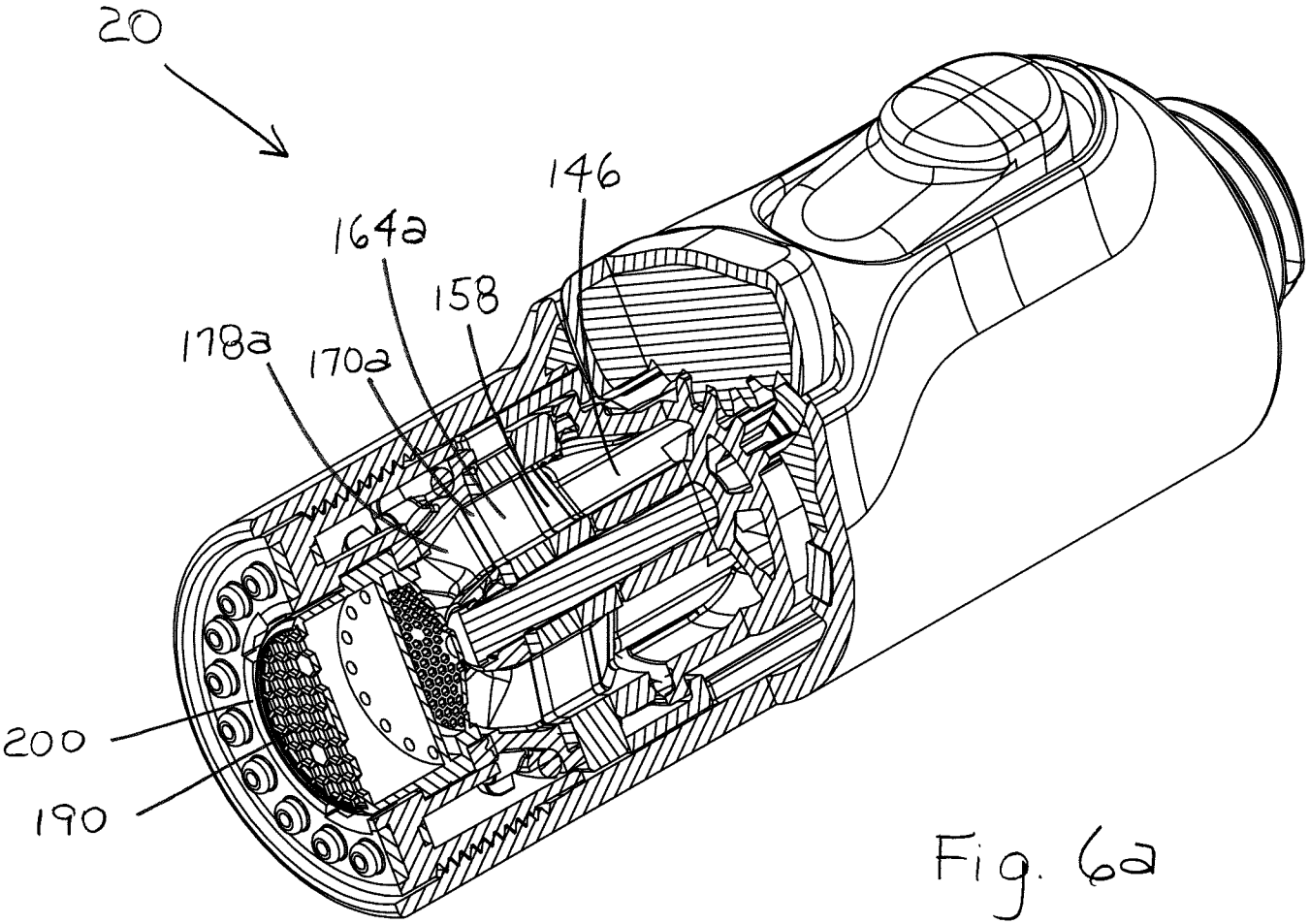
FIGS. 6*a*-6*b* are views of the wand of FIGS. 1*a*-1*d
Figure 6B:
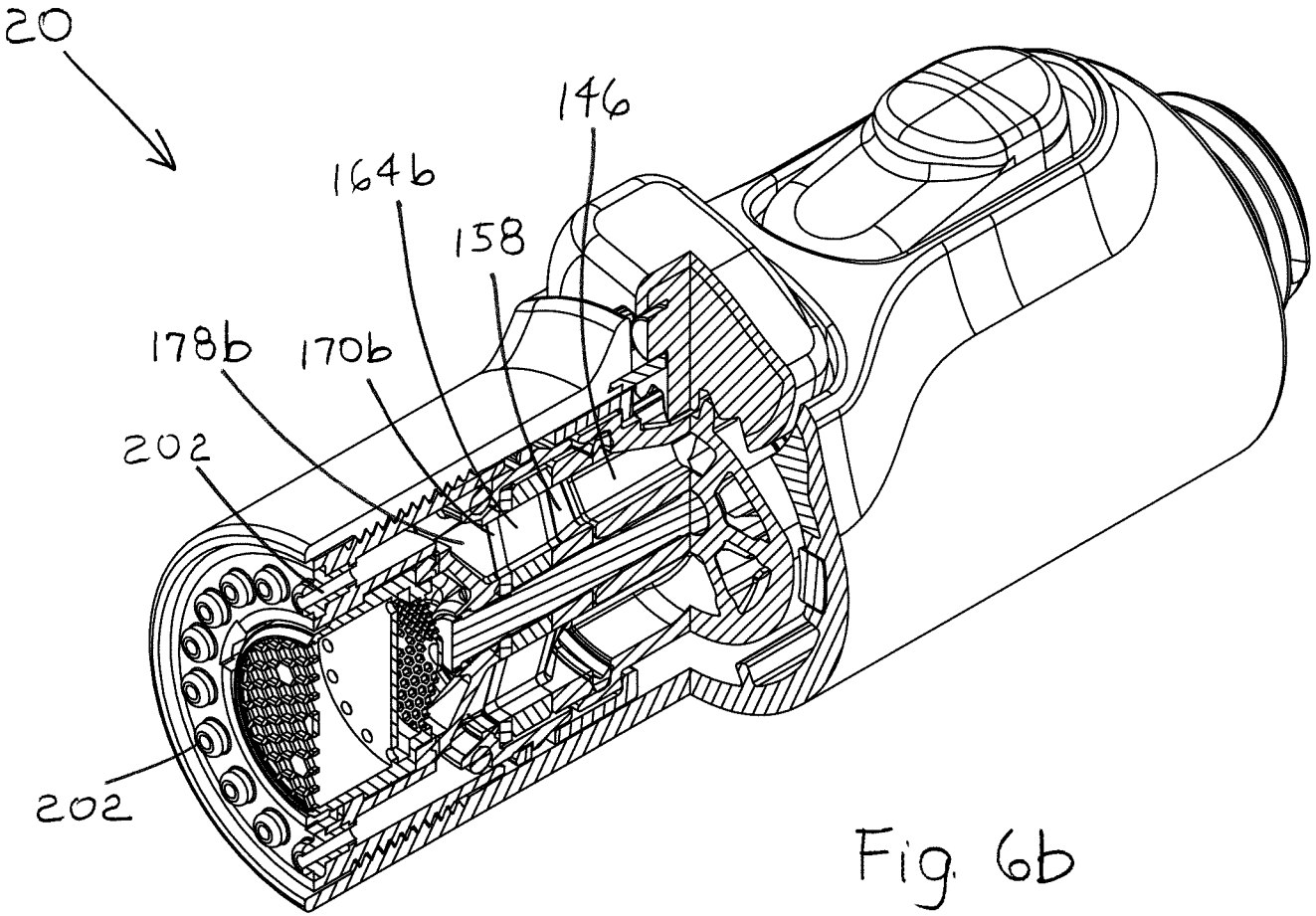

An exemplary embodiment of the boost module 28 is shown in detail in FIGS. 3*a*-1-6*b*. In the illustrated embodiment, the boost module 28 includes a fixed boost sub-module 56 and a movable boost sub-module 58. In the illustrated embodiment, the fixed boost sub-module 56 includes an adapter 60. In the illustrated embodiment, the movable boost sub-module 58 includes a slide 62 and a boost spring 64. Additionally, the boost module 28 includes one or more seals, including a cup seal 66.

An exemplary embodiment of the adapter 60 is shown in detail in FIGS. 3*a*-1-6*b*. In the illustrated embodiment, the adapter 60 includes an upstream end, a mid-section, and a downstream end. The adapter 60 includes an outer surface and an inner surface. The adapter 60 includes a generally cylindrical portion 68 extending from the upstream end to the downstream end. The upstream end of the adapter 60 includes an inlet region 70 and an adapter opening 72. The adapter 60 includes a circumferential ridge 74 extending outwardly from the outer surface in the mid-section. The downstream end of the adapter 60 includes a wall 76 and a plurality of adapter flow openings 78 extending therethrough. In the illustrated embodiment, the plurality of adapter flow openings 78 includes four adapter flow openings 78. The adapter 60 includes an adapter flow passage 80 extending from the adapter opening 72 through the plurality of adapter flow openings 78. The adapter 60 includes a nose portion 82 extending from the wall 76. The nose portion 82 includes an adapter shaft cavity 84 extending therein. The adapter 60 includes threads 86 on the outer surface of the inlet region 70.

An exemplary embodiment of the slide 62 is shown in detail in FIGS. 3*a*-1-6*b*. In the illustrated embodiment, the slide 62 includes an upstream end, a mid-section, and a downstream end. The slide 62 includes a generally cylindrical portion 88 extending from the upstream end to the downstream end. The generally cylindrical portion 88 includes an outer surface and an inner surface. The slide 62 includes a nose portion 90 inside the generally cylindrical portion 88 extending from the mid-section to the downstream end. The nose portion 90 includes an outer surface and an inner surface. The generally cylindrical portion 88 is connected to the nose portion 90 in the mid-section. The upstream end of the generally cylindrical portion 88 includes a slide upstream opening 92. The downstream end of the generally cylindrical portion 88 includes a slide downstream opening 94. The downstream end of the nose portion 90 includes a slide shaft opening 96 and a plurality of slide flow openings 98. In the illustrated embodiment, the plurality of slide flow openings 98 includes three slide flow openings 98. The slide 62 includes a slide flow passage 100 extending from the slide upstream opening 92 through the plurality of slide flow openings 98. The slide 62 includes a slide annulus 102 between the inner surface of the generally cylindrical portion 88 and the outer surface of the nose portion 90 extending from the mid-section to the downstream end. The slide 62 includes a plurality of slide rails 104 extending longitudinally from the outer surface of the generally cylindrical portion 88 from the upstream end to the downstream end. In the illustrated embodiment, the plurality of slide rails 104 includes two slide rails 104.

An exemplary embodiment of the boost spring 64 is shown in detail in FIGS. 3*a*-1-6*b*. In the illustrated embodiment, the boost spring 64 includes an upstream end and a downstream end. In the illustrated embodiment, the boost spring 64 is a coil spring.

An exemplary embodiment of the mode module 30 is shown in detail in FIGS. 3*a*-1-6*b*. In the illustrated embodiment, the mode module 30 includes a fixed mode sub-module 106 and a movable mode sub-module 108. In the illustrated embodiment, the fixed mode sub-module 106 includes a retainer 110, an outlet disk 112, a web seal 114, and a flow guide 116. In the illustrated embodiment, the movable mode sub-module 108 includes a mode selector 118 and an inlet disk 120. Additionally, the mode module 30 includes one or more additional seals, including a gland ring 122, a cup seal 124, and a lip seal 126.

An exemplary embodiment of the retainer 110 is shown in detail in FIGS. 3*a*-1-6*b*. In the illustrated embodiment, the retainer 110 includes an upstream end and a downstream end. The retainer 110 includes an outer surface and an inner surface. The retainer 110 includes a retainer opening 128 extending from the upstream end to the downstream end. The retainer 110 includes a plurality of retainer fingers 130 extending longitudinally from the upstream end. In the illustrated embodiment, the plurality of retainer fingers 130 includes two retainer fingers 130. The retainer 110 includes a plurality of retainer tabs 132 extending longitudinally from the downstream end. In the illustrated embodiment, the plurality of retainer tabs 132 includes four retainer tabs 132. The retainer 110 includes a retainer notch 134 between each pair of adjacent retainer tabs 132. Each of the retainer tabs 132 includes a retainer slot 136 extending therethrough.

An exemplary embodiment of the mode selector 118 is shown in detail in FIGS. 3*a*-1-6*b*. In the illustrated embodiment, the mode selector 118 includes an upstream end, a mid-section, and a downstream end. The mode selector 118 includes an outer surface and an inner surface. The mode selector 118 includes a generally cylindrical portion 138 that extends from the upstream end to the downstream end. The generally cylindrical portion 138 steps outwardly from the upstream end to the mid-section and from the mid-section to the downstream end. The upstream end of the mode selector 118 includes a mode selector upstream opening 140. The downstream end of the mode selector 118 includes a mode selector downstream opening 142, a mode selector shaft opening 144, and a plurality of mode selector flow openings 146. In the illustrated embodiment, the plurality of mode selector flow openings 146 includes six mode selector flow openings 146. In the illustrated embodiment, the mode selector flow openings 146 are equally spaced in a circumferential direction around the mode selector 118. The mode selector 118 includes a mode selector flow passage 148 extending from the mode selector upstream opening 140 to the plurality of mode selector flow openings 146. The mode selector 118 includes a plurality of mode selector tabs 150 extending longitudinally from the downstream end. In the illustrated embodiment, the plurality of mode selector tabs 150 includes four mode selector tabs 150. The mode selector 118 includes a mode selector notch 152 between each pair of adjacent mode selector tabs 150. The mode selector 118 includes a plurality of mode selector teeth 154 extending outwardly from the outer surface in the mid-section. In the illustrated embodiment, the plurality of mode selector teeth 154 includes four mode selector teeth 154.

An exemplary embodiment of the inlet disk 120 is shown in detail in FIGS. 3*a*-1-6*b*. In the illustrated embodiment, the inlet disk 120 includes an upstream end and a downstream end. The inlet disk 120 is generally disk shaped. The inlet disk 120 includes a circumferential edge. The inlet disk 120 includes an inlet disk shaft opening 156 and a plurality of inlet disk flow openings 158 extending from the upstream end through the downstream end. In the illustrated embodiment, the plurality of inlet disk flow openings 158 includes six inlet disk flow openings 158. In the illustrated embodiment, the inlet disk flow openings 158 are equally spaced in a circumferential direction around the inlet disk 120. The inlet disk 120 includes a plurality of inlet disk tabs 160 extending from the circumferential edge. In the illustrated embodiment, the plurality of inlet disk tabs 160 includes four inlet disk tabs 160.

An exemplary embodiment of the outlet disk 112 is shown in detail in FIGS. 3*a*-1-6*b*. In the illustrated embodiment, the outlet disk 112 includes an upstream end and a downstream end. The outlet disk 112 is generally disk shaped. The outlet disk 112 includes a circumferential edge. The outlet disk 112 includes an outlet disk shaft opening 162 and a plurality of outlet disk outlet passages 164 extending from the upstream end through the downstream end. In the illustrated embodiment, the plurality of outlet disk outlet passages 164 includes twelve outlet disk outlet passages 164. In the illustrated embodiment, the plurality of outlet disk outlet passages 164 includes six outlet disk first outlet passages 164*a* and six outlet disk second outlet passages 164*b*. In the illustrated embodiment, the plurality of outlet disk outlet passages 164 includes a plurality of outlet disk stream outlet passages 164*a* and a plurality of outlet disk spray outlet passages 164*b*. In the illustrated embodiment, the plurality of outlet disk stream outlet passages 164*a* includes six outlet disk stream outlet passages 164*a*, and the plurality of outlet disk spray outlet passages 164*b* includes six outlet disk spray outlet passages 164*b*. In the illustrated embodiment, the outlet disk outlet passages 164 are equally spaced in a circumferential direction around the outlet disk 112. In the illustrated embodiment, the outlet disk first or stream outlet passages 164*a* alternate with the outlet disk second or spray outlet passages 164*b*. The outlet disk 112 includes a plurality of outlet disk tabs 166 extending from the circumferential edge. In the illustrated embodiment, the plurality of outlet disk tabs 166 includes four outlet disk tabs 166.

An exemplary embodiment of the web seal 114 is shown in detail in FIGS. 3*a*-1-6*b*. In the illustrated embodiment, the web seal 114 includes an upstream end and a downstream end. The web seal 114 is generally disk shaped. The web seal 114 includes a circumferential edge. The web seal 114 includes a web seal shaft opening 168 and a plurality of web seal outlet passages 170 extending from the upstream end through the downstream end. In the illustrated embodiment, the plurality of web seal outlet passages 170 includes twelve web seal outlet passages 170. In the illustrated embodiment, the plurality of web seal outlet passages 170 includes six web seal first outlet passages 170*a* and six web seal second outlet passages 170*b*. In the illustrated embodiment, the plurality of web seal outlet passages 170 includes a plurality of web seal stream outlet passages 170*a* and a plurality of web seal spray outlet passages 170*b*. In the illustrated embodiment, the plurality of web seal stream outlet passages 170*a* includes six web seal stream outlet passages 170*a*, and the plurality of web seal spray outlet passages 170*b* includes six web seal spray outlet passages 170*b*. In the illustrated embodiment, the web seal outlet passages 170 are equally spaced in a circumferential direction around the web seal 114. In the illustrated embodiment, the web seal first or stream outlet passages 170*a* alternate with the web seal second or spray outlet passages 170*b*. The web seal 114 includes a plurality of web seal tabs 172 extending from the circumferential edge. In the illustrated embodiment, the plurality of web seal tabs 172 includes two web seal tabs 172.

An exemplary embodiment of the flow guide 116 is shown in detail in FIGS. 3*a*-1-6*b*. In the illustrated embodiment, the flow guide 116 includes an upstream end and a downstream end. The flow guide 116 includes an outer surface and an inner surface. The upstream end of the flow guide 116 includes a flow guide opening 174. The downstream end of the flow guide 116 includes a flow guide shaft opening 176 and a plurality of flow guide outlet passages 178. In the illustrated embodiment, the plurality of flow guide outlet passages 178 includes twelve flow guide outlet passages 178. In the illustrated embodiment, the plurality of flow guide outlet passages 178 includes six flow guide first outlet passages 178*a* and six flow guide second outlet passages 178*b*. In the illustrated embodiment, the plurality of flow guide outlet passages 178 includes a plurality of flow guide stream outlet passages 178*a* and a plurality of flow guide spray outlet passages 178*b*. In the illustrated embodiment, the plurality of flow guide stream outlet passages 178*a* includes six flow guide stream outlet passages 178*a*, and the plurality of flow guide spray outlet passages 178*b* includes six flow guide spray outlet passages 178*b*. In the illustrated embodiment, the flow guide outlet passages 178 are equally spaced in a circumferential direction around the flow guide 116. In the illustrated embodiment, the flow guide first or stream outlet passages 178*a* alternate with the flow guide second or spray outlet passages 178*b*. The flow guide 116 includes a plurality of flow guide tabs 180 extending longitudinally from the upstream end. In the illustrated embodiment, the plurality of flow guide tabs 180 includes four flow guide tabs 180. The flow guide 116 includes a flow guide notch 182 between each pair of adjacent flow guide tabs 180. Some flow guide notches 182 include an upstream wider portion 182*a* and a downstream narrower portion 182*b*. Each of the flow guide tabs 180 includes a flow guide projection 184 extending outwardly from the outer surface.

An exemplary embodiment of the shaft 32 is shown in detail in FIGS. 3*a*-1-6*b*. In the illustrated embodiment, the shaft 32 includes an upstream end and a downstream end. The shaft 32 is generally circular in cross-section. The upstream end of the shaft 32 includes two shaft barbs 186. The downstream end of the shaft 32 includes a shaft head 188.

An exemplary embodiment of the face module 34 is shown in detail in FIGS. 3*a*-1-6*b*. In the illustrated embodiment, the face module 34 includes an aerator 190 and a spray face 192. Additionally, the face module 34 includes one or more seals, including an O-ring 194 and a washer 196.

An exemplary embodiment of the aerator 190 is shown in detail in FIGS. 3*a*-1-6*b*. Aerators are well-known in the art and, thus, will not be described in greater detail.

An exemplary embodiment of the spray face 192 is shown in detail in FIGS. 3*a*-1-6*b*. In the illustrated embodiment, the spray face 192 includes an upstream end and a downstream end. The spray face 192 includes an outer surface and an inner surface. The spray face 192 includes a generally cylindrical portion 198 extending from the upstream end to the downstream end. The spray face 192 includes a wand opening 200 and a plurality of wand nozzles 202 in the downstream end. In the illustrated embodiment, the wand opening 200 is central, and the wand nozzles 202 surround the wand opening 200. In an exemplary embodiment, the wand nozzles 202 are integrally formed with the spray face 192. The wand opening 200 fluidly communicates with the flow guide stream outlet passages 178*a* and delivers water from the spray face 192 in the form of a stream. The wand nozzles 202 fluidly communicate with the flow guide spray outlet passages 178*b* and deliver water from the spray face 192 in the form of a spray. The spray face 192 includes threads 204 on the outer surface in the downstream end.

An exemplary embodiment of the boost actuator module 36 is shown in detail in FIGS. 3*a*-1-6*b*. In the illustrated embodiment, the boost actuator module 36 includes a boost toggle button 206 and a boost toggle spring 208.

An exemplary embodiment of the boost toggle button 206 is shown in detail in FIGS. 3*a*-1-6*b*. In the illustrated embodiment, the boost toggle button 206 includes an upstream end, a mid-section, and a downstream end. The boost toggle button 206 includes an outer surface and an inner surface. The boost toggle button 206 is generally oblong shaped. The boost toggle button 206 includes a boost toggle projection 210 extending outwardly from the inner surface in the downstream end forming a boost toggle cavity 212. The boost toggle button 206 includes a plurality of boost saddles 214 extending outwardly from the inner surface in the mid-section. In the illustrated embodiment, the plurality of boost saddles 214 includes two boost saddles 214.

An exemplary embodiment of the boost toggle spring 208 is shown in detail in FIGS. 3*a*-1-6*b*. In the illustrated embodiment, the boost toggle spring 208 includes an upstream end and a downstream end. In the illustrated embodiment, the boost toggle spring 208 is a cantilever or leaf spring.

An exemplary embodiment of the mode actuator module 38 is shown in detail in FIGS. 3*a*-1-6*b*. In the illustrated embodiment, the mode actuator module 38 includes a mode toggle button 216.

An exemplary embodiment of the mode toggle button 216 is shown in detail in FIGS. 3*a*-1-6*b*. In the illustrated embodiment, the mode toggle button 216 includes an upstream end, a downstream end, a mid-section, a first side 218, and a second side 220. The mode toggle button 216 includes an outer surface and an inner surface. The mode toggle button 216 is generally oblong shaped. The mode toggle button 216 includes a plurality of mode pins 222 extending longitudinally from the upstream end and the downstream end. In the illustrated embodiment, the plurality of mode pins 222 includes two mode pins 222, one extending from the upstream end and one extending from the downstream end. The mode toggle button 216 includes a plurality of mode toggle teeth 224 extending outwardly from the inner surface in the mid-section. In the illustrated embodiment, the plurality of mode toggle teeth 224 includes three mode toggle teeth 224.

In the illustrated embodiment, the wand 20 further includes an O-ring 226, a screen 228, and a check valve 230. Exemplary embodiments of these components are shown in detail in FIGS. 3*a*-1-6*b*. These components of the wand 20 are well-known in the art and, thus, will not be described in greater detail.

During assembly of the illustrated embodiment of the wand 20 of FIGS. 3*a*-1-6*b*, the mode module 30 is assembled. Exemplary assembly steps will be described. The web seal 114 is inserted into the flow guide opening 174 until the web seal tabs 172 are received in the downstream narrower portion 182*b* of the flow guide notches 182. Once fully inserted, the web seal outlet passages 170 are aligned with the flow guide outlet passages 178 and, more particularly, the web seal stream outlet passages 170*a* are aligned with the flow guide stream outlet passages 178*a* and the web seal spray outlet passages 170*b* are aligned with the flow guide spray outlet passages 178*b*. The outlet disk 112 is inserted into the flow guide opening 174 until the outlet disk tabs 166 are received in the flow guide notches 182, and for some, in the upstream wider portion 182*a* of the flow guide notches 182. Once fully inserted, the outlet disk outlet passages 164 are aligned with the web seal outlet passages 170 and, more particularly, the outlet disk stream outlet passages 164*a* are aligned with the web seal stream outlet passages 170*a* and the outlet disk spray outlet passages 164*b* are aligned with the web seal spray outlet passages 170*b*. The inlet disk 120 is inserted into the mode selector downstream opening 142 until the inlet disk tabs 160 are received in the mode selector notches 152. Once fully inserted, the inlet disk flow openings 158 are aligned with the mode selector flow openings 146. The downstream end of the mode selector 118 is inserted into the upstream end of the flow guide 116. Once fully inserted, the inlet disk flow openings 158 are centrally aligned with the outlet disk stream outlet passages 164*a* and the outlet disk spray outlet passages 164*b*. The downstream end of the retainer 110 is inserted over the already assembled components of the mode module 30 until the flow guide projections 184 on the flow guide tabs 180 are received in the retainer slots 136 in the retainer tabs 132.

During assembly of the illustrated embodiment of the wand 20 of FIGS. 3*a*-1-6*b*, the boost module 28 is assembled. Exemplary assembly steps will be described. The nose portion 82 of the adapter 60 is inserted into the slide upstream opening 92 and the nose portion 90 of the slide 62. The upstream end of the boost spring 64 is inserted into the slide downstream opening 94 and the slide annulus 102.

During assembly of the illustrated embodiment of the wand 20 of FIGS. 3*a*-1-6*b*, the mode module 30 and the boost module 28 are assembled. Exemplary assembly steps will be described. The already assembled components of the boost module 28 are inserted into the upstream end of the retainer 110 until the boost spring 64 surrounds the upstream end of the generally cylindrical portion 138 of the mode selector 118. The downstream end of the shaft 32 is inserted through the flow guide shaft opening 176, the web seal shaft opening 168, the outlet disk shaft opening 162, the inlet disk shaft opening 156, the mode selector shaft opening 144, and the slide shaft opening 96, and into the adapter shaft cavity 84, until the shaft head 188 is received in the flow guide shaft opening 176 and the shaft barbs 186 are received in the adapter shaft cavity 84. Once fully inserted, the flow guide 116, the web seal 114, the outlet disk 112, the retainer 110, and the adapter 60 are generally fixed relative to the shaft 32, and the inlet disk 120, the mode selector 118, the boost spring 64, and the slide 62 are generally movable relative to the shaft 32.

During assembly of the illustrated embodiment of the wand 20 of FIGS. 3*a*-1-6*b*, the boost actuator module 36 is assembled. Exemplary assembly steps will be described. The boost toggle button 206 is inserted into the boost toggle opening 44 in the shell 24 until the boost pins 48 of the shell 24 are received in the boost saddles 214 of the boost toggle button 206. The boost toggle spring 208 is inserted into the upstream end of the shell 24 until the downstream end of the boost toggle spring 208 is received in the boost toggle cavity 212 of the boost toggle button 206.

During assembly of the illustrated embodiment of the wand 20 of FIGS. 3*a*-1-6*b*, the already assembled mode module 30 and boost module 28 and the already assembled shell 24 and boost actuator module 36 are further assembled. Exemplary assembly steps will be described. The upstream end of the already assembled mode module 30 and boost module 28 are inserted into the downstream end of the shell 24 until the slide rails 104 are received in the shell slots 52, the retainer fingers 130 are received in the shell slots 52, the ridge 74 on the adapter 60 abuts the boost toggle spring 208, and the ridge 74 on the adapter 60 abuts the upstream end of the shell 24.

During assembly of the illustrated embodiment of the wand 20 of FIGS. 3*a*-1-6*b*, the face module 34 is assembled. Exemplary assembly steps will be described. The aerator 190 is inserted into the wand opening 200 in the spray face 192. The upstream end of the spray face 192 is inserted into the downstream end of the shell 24 until the threads 204 on the spray face 192 mate with the threads 54 in the shell 24.

During assembly of the illustrated embodiment of the wand 20 of FIGS. 3*a*-1-6*b*, the mode actuator module 38 is assembled. Exemplary assembly steps will be described. The mode toggle button 216 is inserted into the mode toggle opening 46 in the shell 24 until the mode pins 222 of the mode toggle button 216 are received in the mode saddles 50 of the shell 24 and the mode toggle teeth 224 are interleaved with the mode selector teeth 154. In the illustrated embodiment, if the first side 218 of the mode toggle button 216 is depressed, there is a starting stream flow, and the inlet disk flow openings 158 are aligned with the outlet disk stream outlet passages 164*a*. In the illustrated embodiment, if the second side 220 of the mode toggle button 216 is depressed, there is a starting spray flow, and the inlet disk flow openings 158 are aligned with the outlet disk spray outlet passages 164*b*.

During assembly of the illustrated embodiment of the wand 20 of FIGS. 3*a*-1-6*b*, other flow components are assembled. Exemplary assembly steps will be described. The check valve 230 and the screen 228 are inserted into the adapter opening 72. The wand hose 22 is connected to the inlet region 70 of the adapter 60 until threads on the wand hose 22 mate with the threads 86 on the adapter 60.

During operation of the illustrated embodiment of the wand 20 of FIGS. 3*a*-1-6*b*, water flows from the wand hose 22 into the wand 20. Depending on whether boost is selected, water will continue through and exit the wand 20 as a normal flow or a boost flow. Additionally, depending on which mode is selected, water will continue through and exit the wand 20 as a stream or a spray. As a result, water exiting the wand 20 can be a normal flow stream, a normal flow spray, a boost flow stream, or a boost flow spray. However, one of ordinary skill in the art will appreciate that more or less flows and/or modes could be provided. Similarly, one of ordinary skill in the art will appreciate that different flows and/or modes could be provided. As an example, a third flow could be a low flow. As another example, a third mode could include both stream and spray, be a different stream, or be a different spray. As another example, both modes could be different streams or both modes could be different sprays.

When water is not flowing to the wand 20 (see FIG. 5*a*), the boost toggle projection 210 of the boost toggle button 206 is spaced from the downstream end of the generally cylindrical portion 88 of the slide 62. With normal flow (see FIG. 5*b*), as water starts to flow to the wand 20, water pressure causes the slide 62 to compress the boost spring 64 and move in a downstream direction until the downstream end of the generally cylindrical portion 88 of the slide 62 abuts the boost toggle projection 210 of the boost toggle button 206. In this position, as water exits the adapter flow passage 80 (including the adapter flow openings 78), water enters the slide flow passage 100 slightly upstream of the nose portion 90 of the slide 62. The constrained space in the slide flow passage 100 restricts water flow.

Figure 5A:
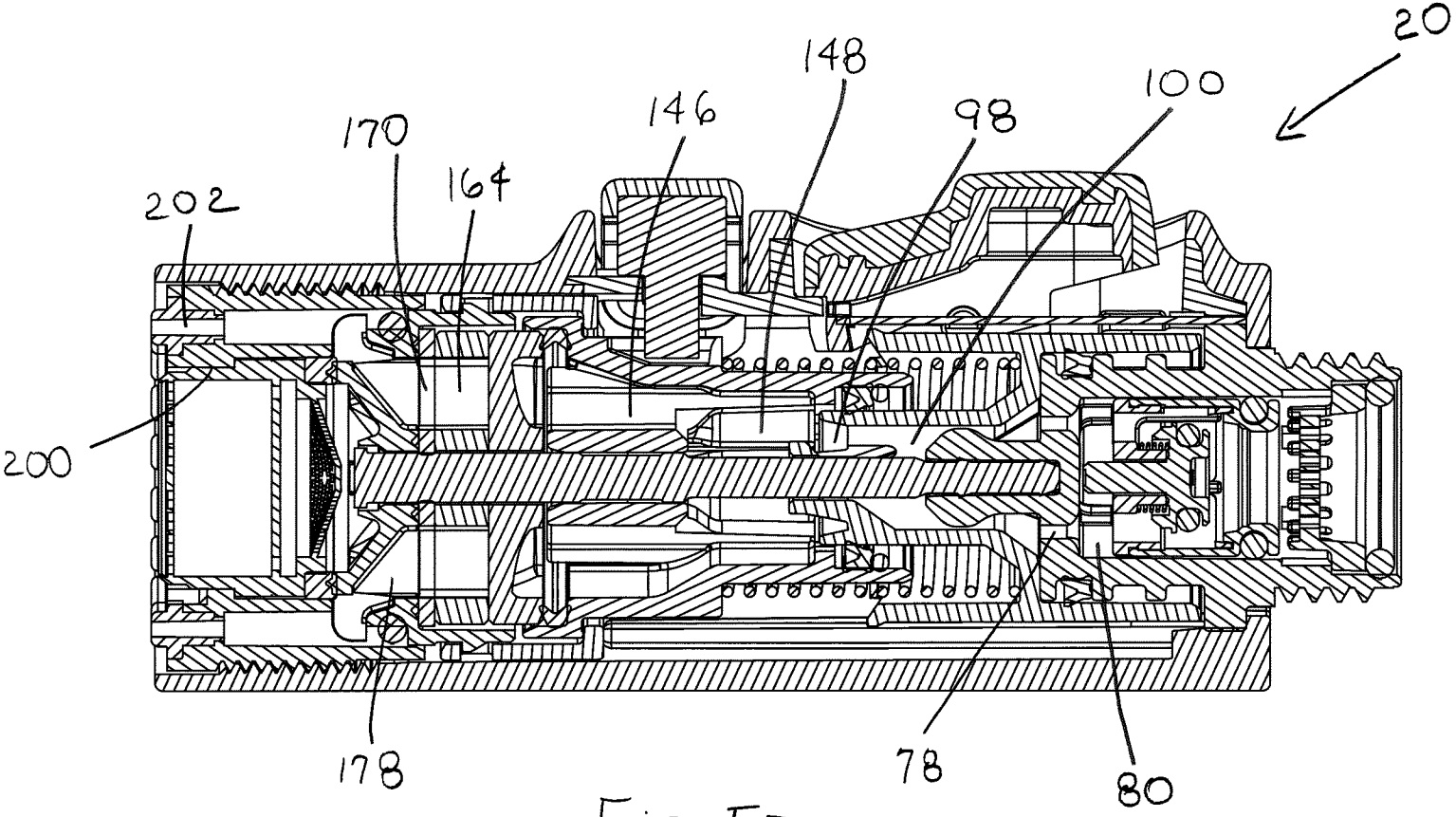
FIGS. 5*a*-5*c* are views of the wand of FIGS. 1*a*-1*d
Figure 5B:
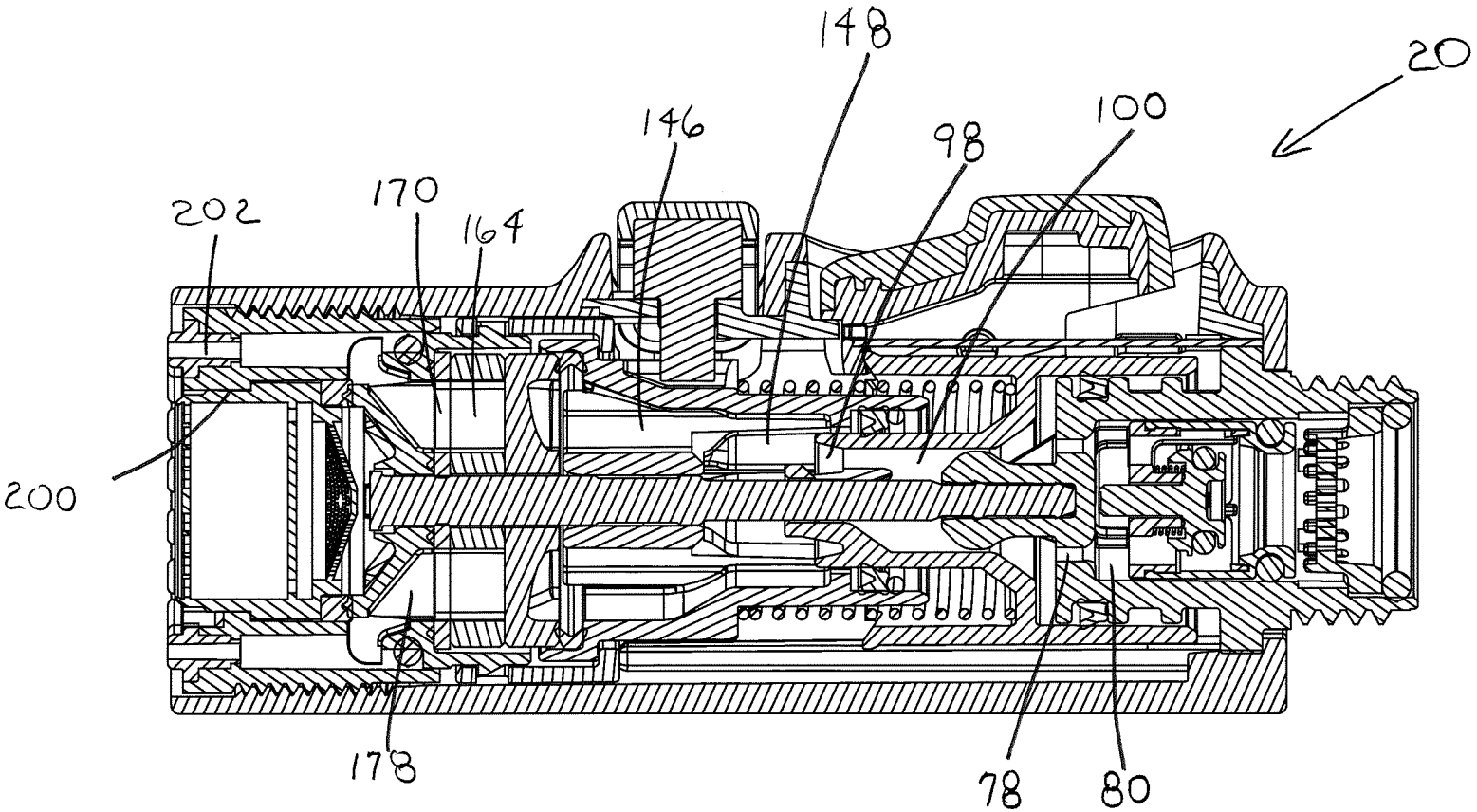
Figure 5C:
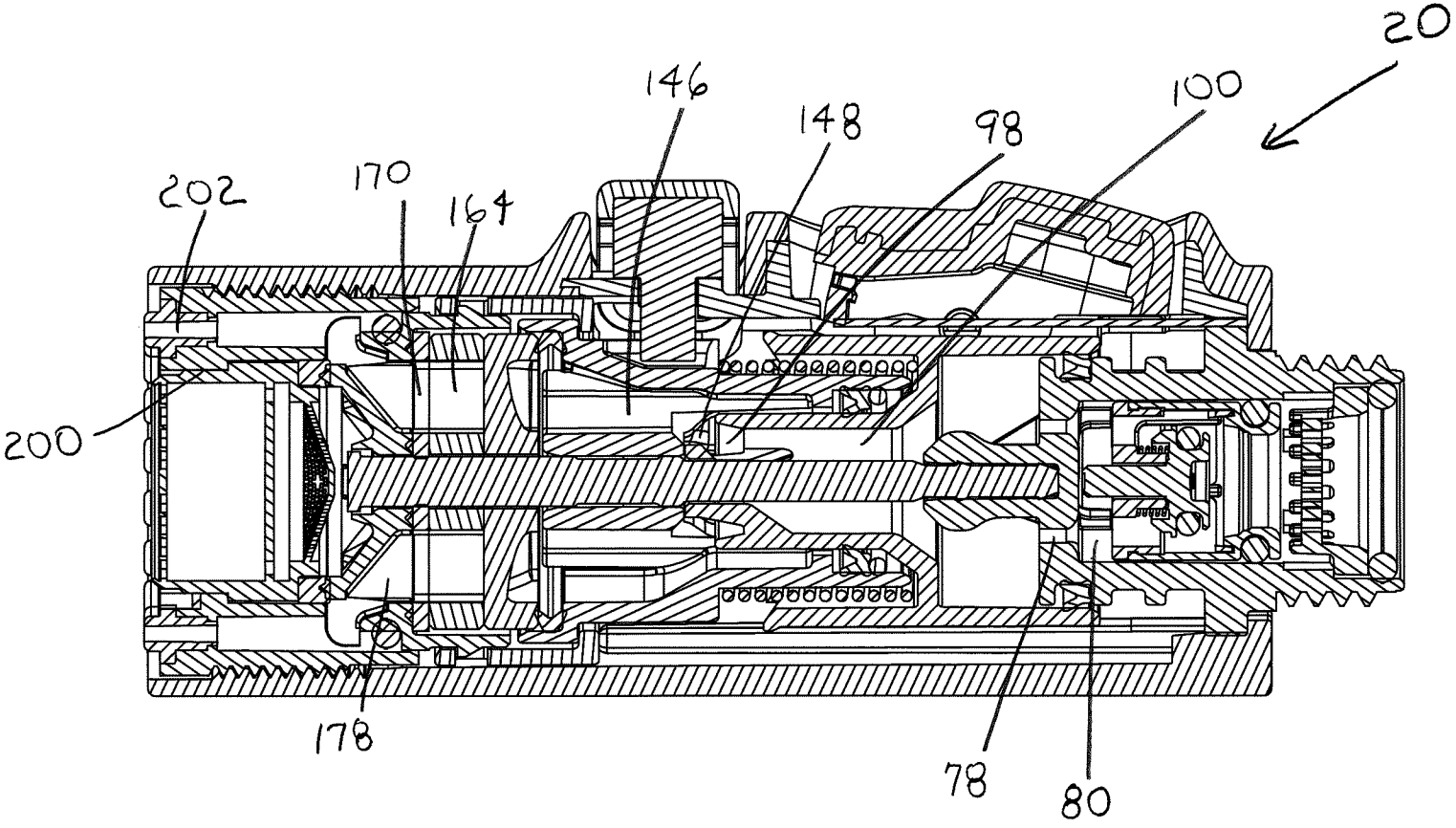

The boost is selected by pressing on the upstream end of the boost toggle button 206 (see FIG. 5*c*). As the upstream end of the boost toggle button 206 is pressed, the downstream end of the boost toggle button 206 is raised causing the boost toggle projection 210 of the boost toggle button 206 to be raised. With boost flow, increased water pressure causes the slide 62 to further compress the boost spring 64 and further move in the downstream direction. In this position, as water exits the adapter flow passage 80 (including the adapter flow openings 78), water enters the slide flow passage 100 further upstream of the nose portion 90 of the slide 62. The less constrained space in the slide flow passage 100 increases water flow.

In the normal flow (see FIG. 5*b*) of the illustrated embodiment of the wand 20 of FIGS. 3*a*-1-6*b*, water flows through the boost module 28 components of the wand 20 in the following order: (1) the screen 228, (2) the check valve 230, (3) the adapter flow passage 80 (including the adapter flow openings 78), and (4) a more restricted portion of the slide flow passage 100 (including the slide flow openings 98).

In the boost flow (see FIG. 5*c*) of the illustrated embodiment of the wand 20 of FIGS. 3*a*-1-6*b*, water flows through the boost module 28 components of the wand 20 in the following order: (1) the screen 228, (2) the check valve 230, (3) the adapter flow passage 80 (including the adapter flow openings 78), and (4) a less restricted portion of the slide flow passage 100 (including the slide flow openings 98).

When water stops flowing to the wand 20, the boost spring 64 causes the slide 62 to move in an upstream direction and return to the position shown in FIG. 5*a*. Additionally, the boost toggle spring 208 causes the boost toggle button 206 to toggle and return to the position shown in FIG. 5*a*.

The mode is selected by pressing on the first side 218 or the second side 220 of the mode toggle button 216. As the first side 218 of the mode toggle button 216 is pressed (see FIG. 6*a*), the interaction of the mode toggle teeth 224 and the mode selector teeth 154 causes the mode selector 118 and the inlet disk 120 to rotate in a counterclockwise direction. In this position, the mode selector flow openings 146 and the inlet disk flow openings 158 align with the outlet disk stream outlet passages 164*a*, the web seal stream outlet passages 170*a*, the flow guide stream outlet passages 178*a*, and the aerator 190 in the wand opening 200 of the wand 20. As the second side 220 of the mode toggle button 216 is pressed (see FIG. 6*b*), the interaction of the mode toggle teeth 224 and the mode selector teeth 154 causes the mode selector 118 and the inlet disk 120 to rotate in a clockwise direction. In this position, the mode selector flow openings 146 and the inlet disk flow openings 158 align with the outlet disk spray outlet passages 164*b*, the web seal spray outlet passages 170*b*, the flow guide spray outlet passages 178*b*, and the wand nozzles 202.

In the stream mode (see FIG. 6*a*) of the illustrated embodiment of the wand 20 of FIGS. 3*a*-1-6*b*, water flows through the mode module 30 components of the wand 20 in the following order: (1) the mode selector flow passage 148, (2) the mode selector flow openings 146, (3) the inlet disk flow openings 158, (4) the outlet disk stream outlet passages 164*a*, (5) the web seal stream outlet passages 170*a*, (6) the flow guide stream outlet passages 178*a*, and (7) the aerator 190 in the wand opening 200 of the wand 20.

In the spray mode (see FIG. 6*b*) of the illustrated embodiment of the wand 20 of FIGS. 3*a*-1-6*b*, water flows through the mode module 30 components of the wand 20 in the following order: (1) the mode selector flow passage 148, (2) the mode selector flow openings 146, (3) the inlet disk flow openings 158, (4) the outlet disk spray outlet passages 164*b*, (5) the web seal spray outlet passages 170*b*, (6) the flow guide spray outlet passages 178*b*, and (7) the wand nozzles 202.

As described above, in the illustrated embodiment, the boost module 28 includes the fixed boost sub-module 56 and the movable boost sub-module 58. Similarly, the mode module 30 includes the fixed mode sub-module 106 and the movable mode sub-module 108. Further, the fixed boost sub-module 56 includes a single component (i.e., the adapter 60), and the movable boost sub-module 58 includes a plurality of components (i.e., the slide 62 and the boost spring 64). Similarly, the fixed mode sub-module 106 includes a plurality of components (i.e., the retainer 110, the outlet disk 112, the web seal 114, and the flow guide 116), and the movable mode sub-module 108 includes a plurality of components (i.e., the mode selector 118 and the inlet disk 120). Additionally, the face module 34 includes a plurality of components (i.e., the aerator 190 and the spray face 192). However, one of ordinary skill in the art will appreciate that each of the fixed boost sub-module 56, the movable boost sub-module 58, the fixed mode sub-module 106, the movable mode sub-module 108, and the face module 34 could include a single component or a plurality of components.

In an exemplary embodiment, the fixed boost sub-module 56 includes an inlet region (e.g., the inlet region 70 of the adapter 60) and a first flow passage (e.g., the adapter flow passage 80). Additionally, the movable boost sub-module 58 includes a second flow passage (e.g., the slide flow passage 100). Further, the movable mode sub-module 108 includes a third flow passage (e.g., the mode selector flow passage 148) and a plurality of flow openings (e.g., the mode selector flow openings 146 and the inlet disk flow openings 158). Moreover, the fixed mode sub-module 106 includes a plurality of first outlet passages (e.g., the outlet disk stream outlet passages 164*a*, the web seal stream outlet passages 170*a*, and the flow guide stream outlet passages 178*a*) and a plurality of second outlet passages (e.g., the outlet disk spray outlet passages 164*b*, the web seal spray outlet passages 170*b*, and the flow guide spray outlet passages 178*b*).

In an exemplary embodiment, the movable boost sub-module 58 (e.g., the slide 62 and the boost spring 64) is operable to move in a generally longitudinal direction (i.e., along or generally parallel to a central longitudinal axis of the shell 24); and the movable mode sub-module 108 (e.g., the mode selector 118 and the inlet disk 120) is operable to move in a generally circumferential direction (i.e., around a circumference of the shell 24).

In an exemplary embodiment, the first flow passage (e.g., the adapter flow passage 80), the second flow passage (e.g., the slide flow passage 100), the third flow passage (e.g., the mode selector flow passage 148), the plurality of flow openings (e.g., the mode selector flow openings 146 and the inlet disk flow openings 158), the plurality of first outlet passages (e.g., the outlet disk stream outlet passages 164*a,* the web seal stream outlet passages 170*a,* and the flow guide stream outlet passages 178*a*), and the plurality of second outlet passages (e.g., the outlet disk spray outlet passages 164*b,* the web seal spray outlet passages 170*b,* and the flow guide spray outlet passages 178*b*) extend in a generally longitudinal direction (i.e., along or generally parallel to the central longitudinal axis of the shell 24); and the flow of water through the first flow passage (e.g., the adapter flow passage 80), the second flow passage (e.g., the slide flow passage 100), the third flow passage (e.g., the mode selector flow passage 148), the plurality of flow openings (e.g., the mode selector flow openings 146 and the inlet disk flow openings 158), the plurality of first outlet passages (e.g., the outlet disk stream outlet passages 164*a,* the web seal stream outlet passages 170*a,* and the flow guide stream outlet passages 178*a*), and the plurality of second outlet passages (e.g., the outlet disk spray outlet passages 164*b,* the web seal spray outlet passages 170*b,* and the flow guide spray outlet passages 178*b*) extends in a generally longitudinal direction (i.e., along or generally parallel to the central longitudinal axis of the shell 24).

In an exemplary embodiment, the movable boost sub-module 58 (e.g., the slide 62) is operable to move away from and toward the fixed boost sub-module 56 (e.g., the adapter 60). As the movable boost sub-module 58 (e.g., the slide 62) moves away from the fixed boost sub-module 56 (e.g., the adapter 60), the flow of water through the second flow passage (e.g., the slide flow passage 100) increases. As the movable boost sub-module 58 (e.g., the slide 62) moves toward the fixed boost sub-module 56 (e.g., the adapter 60), the flow of water through the second flow passage (e.g., the slide flow passage 100) decreases.

In an exemplary embodiment, the boost actuator module 36 (e.g., the boost toggle button 206) is operable to engage the movable boost sub-module 58 (e.g., the slide 62) to limit movement of the movable boost sub-module 58 (e.g., the slide 62) away from the fixed boost sub-module 56 (e.g., the adapter 60). Further, the boost actuator module 36 (e.g., the boost toggle button 206) is operable to disengage the movable boost sub-module 58 (e.g., the slide 62) to enable movement of the movable boost sub-module 58 (e.g., the slide 62) away from the fixed boost sub-module 56 (e.g., the adapter 60).

In an exemplary embodiment, the movable mode sub-module 108 (e.g., the mode selector 118 and the inlet disk 120) is operable to rotate in a counterclockwise direction and a clockwise direction relative to the fixed mode sub-module 106 (e.g., the outlet disk 112, the web seal 114, and the flow guide 116). As the movable mode sub-module 108 (e.g., the mode selector 118 and the inlet disk 120) rotates in a counterclockwise direction relative to the fixed mode sub-module 106 (e.g., the outlet disk 112, the web seal 114, and the flow guide 116), water flows from the plurality of flow openings (e.g., the mode selector flow openings 146 and the inlet disk flow openings 158) to the plurality of first outlet passages (e.g., the outlet disk stream outlet passages 164*a,* the web seal stream outlet passages 170*a,* and the flow guide stream outlet passages 178*a*). As the movable mode sub-module 108 (e.g., the mode selector 118 and the inlet disk 120) rotates in a clockwise direction relative to the fixed mode sub-module 106 (e.g., the outlet disk 112, the web seal 114, and the flow guide 116), water flows from the plurality of flow openings (e.g., the mode selector flow openings 146 and the inlet disk flow openings 158) to the plurality of second outlet passages (e.g., the outlet disk spray outlet passages 164*b,* the web seal spray outlet passages 170*b,* and the flow guide spray outlet passages 178*b*).

In an exemplary embodiment, the mode actuator module 38 (e.g., the mode toggle button 216) is operable to engage the movable mode sub-module 108 (e.g., the mode selector 118) to rotate the movable mode sub-module 108 (e.g., the mode selector 118 and the inlet disk 120) in a counterclockwise direction. Further, the mode actuator module 38 (e.g., the mode toggle button 216) is operable to engage the movable mode sub-module 108 (e.g., the mode selector 118) to rotate the movable mode sub-module 108 (e.g., the mode selector 118 and the inlet disk 120) in a clockwise direction.

In an exemplary embodiment, the face module 34 includes a first outlet (e.g., the aerator 190 and the wand opening 200) and a second outlet (e.g., the wand nozzles 202). In an exemplary embodiment, the first outlet (e.g., the aerator 190 and the wand opening 200) is operable to fluidly communicate with the plurality of first outlet passages (e.g., the outlet disk stream outlet passages 164*a,* the web seal stream outlet passages 170*a,* and the flow guide stream outlet passages 178*a*) and deliver water from the face module 34 in a first form (e.g., the stream). Similarly, the second outlet (e.g., the wand nozzles 202) is operable to fluidly communicate with the plurality of second outlet passages (e.g., the outlet disk spray outlet passages 164*b,* the web seal spray outlet passages 170*b,* and the flow guide spray outlet passages 178*b*) and deliver water from the face module 34 in a second form (e.g., the spray).

Figure 7:
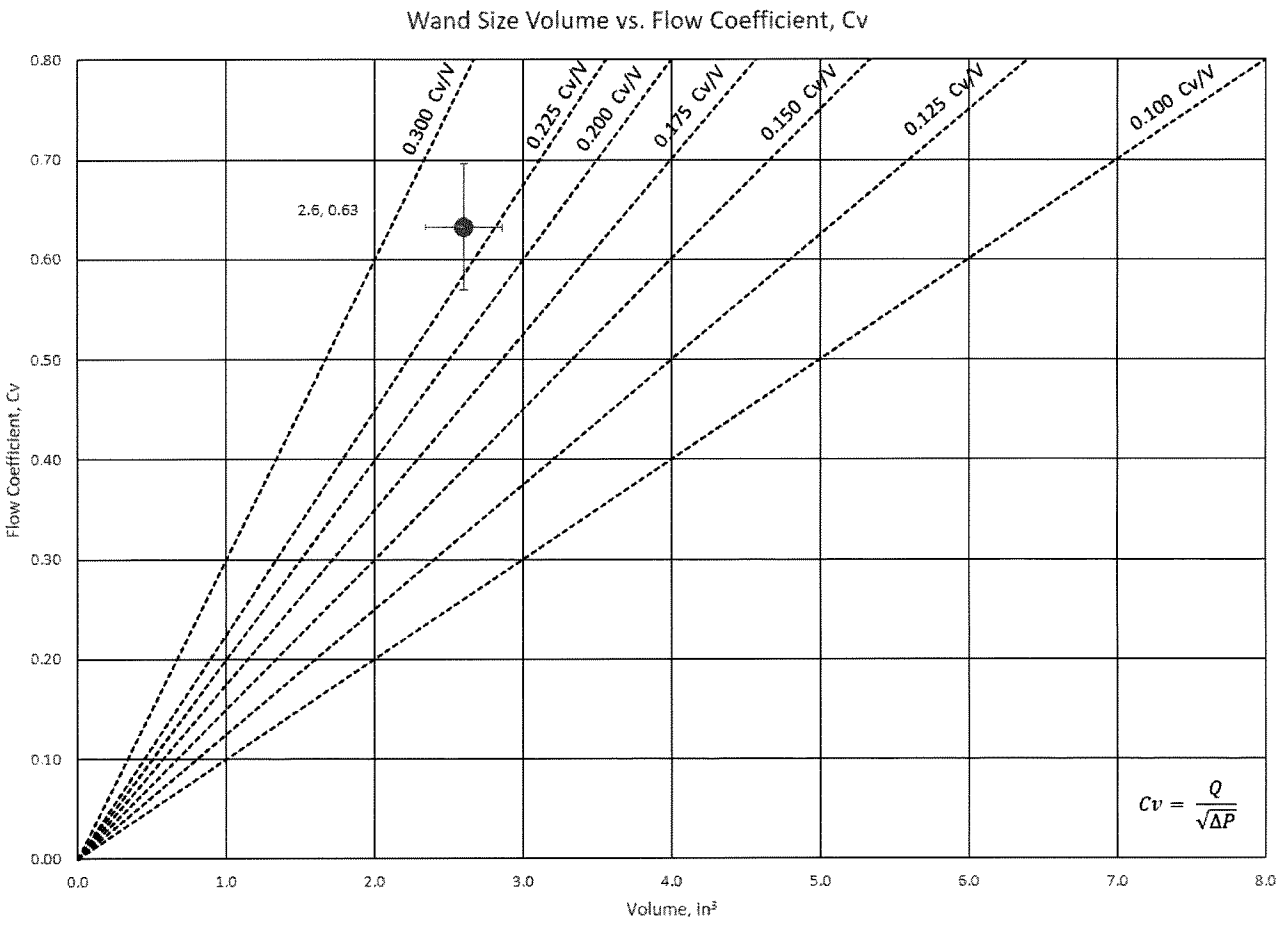
FIG. 7 is a graph showing a flow coefficient vs. a volume of the wand of FIGS. 1*a*-1*d*.

In an exemplary embodiment, the wand 20 has a high flow capacity and a compact size. In an exemplary embodiment, the flow capacity of the wand 20 is represented by a flow coefficient, $C_v$, of the wand 20. The flow coefficient, $C_v$, is defined as a flow rate, Q, of the wand 20 (in gallons per minute) divided by a square root of a pressure differential, $\Delta P$, between an inlet and an outlet of the wand 20 (in pounds per square inch), where the specific gravity is 1 (for water). In equation form, $C_v=Q/(\sqrt{\Delta P})$. For the illustrated embodiment, with water exiting the wand 20 in the boost flow stream, the flow coefficient, $C_v$, of the wand 20 is approximately 0.63. In an exemplary embodiment, the size of the wand 20 is represented by a volume, V, of the shell 24. In the illustrated embodiment, the volume, V, is defined as a diameter, d, of the shell 24 (in inches squared) times a length, l, of the shell 24 (in inches). In equation form, $V=d*1$. For the illustrated embodiment, the volume, V, of the shell 24 is approximately 2.6 inches cubed. In an exemplary embodiment, with water exiting the wand 20 in the boost flow stream, a ratio of the flow coefficient of the wand 20 to the volume of the shell 24 is greater than approximately 0.125 (see FIG. 7). In an exemplary, with water exiting the wand 20 in the boost flow stream, the ratio of the flow coefficient of the wand 20 to the volume of the shell 24 is greater than approximately 0.15. In an exemplary embodiment, with water exiting the wand 20 in the boost flow stream, the ratio of the flow coefficient of the wand 20 to the volume of the shell 24 is greater than approximately 0.175. In an exemplary embodiment, with water exiting the wand 20 in the boost flow stream, the ratio of the flow coefficient of the wand 20 to the volume of the shell 24 is greater than approximately 0.2. In an exemplary embodiment, with water exiting the wand 20 in the boost flow stream, the ratio of the flow coefficient of the wand 20 to the volume of the shell 24 is greater than approximately 0.225. In the illustrated embodiment, with water exiting the wand 20 in the boost flow stream, the ratio of the flow coefficient of the wand 20 to the volume of the shell 24 is approximately 0.24.

While the wand 20 has been shown and described in the illustrated embodiment as including certain components, one of ordinary skill in the art will appreciate that the wand 20 does not need to include each of these components and/or the specifics of each of these components.

For example, the adapter 60, the slide 62, the mode selector 118, and the inlet disk 120 have been shown and described as including a certain number of flow openings and the outlet disk 112, the web seal 114, and the flow guide 116 have been shown and described as including a certain number of outlet passages. However, one of ordinary skill in the art will appreciate that there could be more or less flow openings and/or outlet passages in any of these components. Additionally, the flow openings and the outlet passages have been shown and described as being equally spaced in a circumferential direction around these components. However, one of ordinary skill in the art will appreciate that the flow openings and outlet passages could not be equally spaced in a circumferential direction around any of these components. Further, the first or stream outlet passages and the second or spray outlet passages have been shown and described as alternating in these components. However, one of ordinary skill in the art will appreciate that the first or stream outlet passages and the second or spray outlet passages could not be alternating in any of these components.

Similarly, the shell 24, the boost toggle button 206, the mode toggle button 216, the slide 62, the retainer 110, the mode selector 118, the inlet disk 120, the outlet disk 112, the web seal 114, and the flow guide 116 have been shown and described as including a certain number of pins, saddles, slots, projections, cavities, teeth, rails, fingers, tabs, and/or notches. However, one of ordinary skill in the art will appreciate that there could be more or less pins, saddles, slots, projections, cavities, teeth, rails, fingers, tabs, and/or notches in any of these components. Moreover, there could be other structure that accomplishes the functions of the pins, saddles, slots, projections, cavities, teeth, rails, fingers, tabs, and/or notches in any of these components.

While the wand 20 has been shown and described in the illustrated embodiment with the components attached or engaged in a particular manner, one of ordinary skill in the art will appreciate that the components of the wand 20 do not need to be attached in this particular manner.

While the wand 20 has been shown and described in the illustrated embodiment with the components assembled in a particular order, one of ordinary skill in the art will appreciate that the components of the wand 20 do not need to be assembled in this particular order.

One of ordinary skill in the art will now appreciate that the present invention provides a wand with boost and mode selections having a high flow capacity and a compact size. Although the present invention has been shown and described with reference to a particular embodiment, equivalent alterations and modifications will occur to those skilled in the art upon reading and understanding this specification. The present invention includes all such equivalent alterations and modifications and is limited only by the scope of the following claims in light of their full scope of equivalents.

What is claimed is:

1. A wand, comprising:

a shell, the shell operable to pull away from a faucet;

a waterway, the waterway operable to be substantially disposed in the shell, the waterway including a boost module and a mode module;

the boost module including a fixed boost sub-module and a movable boost sub-module;

the mode module including a fixed mode sub-module and a movable mode sub-module;

the fixed boost sub-module including an inlet region and a first flow passage, the inlet region operable to connect to a water hose, the first flow passage operable to fluidly communicate with the water hose;

the movable boost sub-module including a second flow passage, the second flow passage operable to fluidly communicate with the first flow passage;

the movable mode sub-module including a third flow passage and a plurality of flow openings, the third flow passage operable to fluidly communicate with the second flow passage, the plurality of flow openings operable to fluidly communicate with the third flow passage;

the fixed mode sub-module including a plurality of first outlet passages and a plurality of second outlet passages, the plurality of first outlet passages operable to fluidly communicate with the plurality of flow openings, the plurality of second outlet passages operable to fluidly communicate with the plurality of flow openings; and a face module, the face module including a first outlet and a second outlet, the first outlet operable to fluidly communicate with the plurality of first outlet passages and deliver water from the face module in a first form, the second outlet operable to fluidly communicate with the plurality of second outlet passages and deliver water from the face module in a second form;

wherein the movable boost sub-module is operable to move in a generally longitudinal direction with respect to a longitudinal axis of the shell;

wherein the movable mode sub-module is operable to move in a generally circumferential direction; and wherein, when water is flowing to the wand, the boost module is operable to increase water flow from a non-boosted flow to a boosted flow.

2. The wand of claim 1, wherein:

the movable boost sub-module is operable to move away from and toward the fixed boost sub-module;

as the movable boost sub-module moves away from the fixed boost sub-module, the flow of water through the second flow passages increases; and as the movable boost sub-module moves toward the fixed boost sub-module, the flow of water through the second flow passage decreases.

3. The wand of claim 2, further including a boost actuator module, the boost actuator module operable to engage the movable boost sub-module to limit movement of the movable boost sub-module away from the fixed boost sub-module; and the boost actuator module operable to disengage the movable boost sub-module to enable movement of the movable boost sub-module away from the fixed boost sub-module.

4. The wand of claim 1, wherein:

the movable mode sub-module is operable to rotate in a counterclockwise direction and a clockwise direction relative to the fixed mode sub-module;

as the movable mode sub-module rotates in a counterclockwise direction relative to the fixed mode sub-module, water flows from the plurality of flow openings to the plurality of first outlet passages; and as the movable mode sub-module rotates in a clockwise direction relative to the fixed mode sub-module, water flows from the plurality of flow openings to the plurality of second outlet passages.

5. The wand of claim 4, further including a mode actuator module, the mode actuator module operable to engage the movable mode sub-module to rotate the movable mode sub-module in a counterclockwise direction; and the mode actuator module operable to engage the movable mode sub-module to rotate the movable mode sub-module in a clockwise direction.

6. The wand of claim 1, wherein the fixed boost sub-module includes an adapter, and the movable boost sub-module includes a slide and a boost spring.

7. The wand of claim 1, wherein the fixed mode sub-module includes a retainer, an outlet disk, a web seal, and a flow guide, and the movable mode sub-module includes a mode selector and an inlet disk.

8. A wand, comprising:

a shell, the shell operable to pull away from a faucet;

a waterway, the waterway operable to be substantially disposed in the shell, the waterway including a boost module and a mode module;

the boost module including a fixed boost sub-module and a movable boost sub-module;

the mode module including a fixed mode sub-module and a movable mode sub-module;

the fixed boost sub-module including an inlet region and a first flow passage, the inlet region operable to connect to a water hose, the first flow passage operable to fluidly communicate with the water hose;

the movable boost sub-module including a second flow passage, the second flow passage operable to fluidly communicate with the first flow passage;

the movable mode sub-module including a third flow passage and a plurality of flow openings, the third flow passage operable to fluidly communicate with the second flow passage, the plurality of flow openings operable to fluidly communicate with the third flow passage;

the fixed mode sub-module including a plurality of first outlet passages and a plurality of second outlet passages, the plurality of first outlet passages operable to fluidly communicate with the plurality of flow openings, the plurality of second outlet passages operable to fluidly communicate with the plurality of flow openings; and a face module, the face module including a first outlet and a second outlet, the first outlet operable to fluidly communicate with the plurality of first outlet passages and deliver water from the face module in a first form, the second outlet operable to fluidly communicate with the plurality of second outlet passages and deliver water from the face module in a second form;

wherein the movable boost sub-module is operable to move in a generally longitudinal direction with respect to a longitudinal axis of the shell; and wherein, when water is flowing to the wand, the boost module is operable to increase water flow from a non-boosted flow to a boosted flow.

9. The wand of claim 8, wherein:

the movable boost sub-module is operable to move away from and toward the fixed boost sub-module;

as the movable boost sub-module moves away from the fixed boost sub-module, the flow of water through the second flow passages increases; and as the movable boost sub-module moves toward the fixed boost sub-module, the flow of water through the second flow passage decreases.

10. The wand of claim 9, further including a boost actuator module, the boost actuator module operable to engage the movable boost sub-module to limit movement of the movable boost sub-module away from the fixed boost sub-module; and the boost actuator module operable to disengage the movable boost sub-module to enable movement of the movable boost sub-module away from the fixed boost sub-module.

11. The wand of claim 8, wherein:

the movable mode sub-module is operable to rotate in a counterclockwise direction and a clockwise direction relative to the fixed mode sub-module;

as the movable mode sub-module rotates in a counterclockwise direction relative to the fixed mode sub-module, water flows from the plurality of flow openings to the plurality of first outlet passages; and as the movable mode sub-module rotates in a clockwise direction relative to the fixed mode sub-module, water flows from the plurality of flow openings to the plurality of second outlet passages.

12. The wand of claim 11, further including a mode actuator module, the mode actuator module operable to engage the movable mode sub-module to rotate the movable mode sub-module in a counterclockwise direction; and the mode actuator module operable to engage the movable mode sub-module to rotate the movable mode sub-module in a clockwise direction.

13. The wand of claim 8, wherein the fixed boost sub-module includes an adapter, and the movable boost sub-module includes a slide and a boost spring.

14. The wand of claim 8, wherein the fixed mode sub-module includes a retainer, an outlet disk, a web seal, and a flow guide, and the movable mode sub-module includes a mode selector and an inlet disk.

15. The wand of claim 1, wherein the non-boosted flow includes at least one of a normal flow and a low flow.

16. The wand of claim 1, wherein, when water stops flowing to the wand, the boost module is operable to return to a non-boosted flow position.

17. The wand of claim 8, wherein the non-boosted flow includes at least one of a normal flow and a low flow.

18. The wand of claim 8, wherein, when water stops flowing to the wand, the boost module is operable to return to a non-boosted flow position.

19. A wand, comprising:

a shell, the shell operable to pull away from a faucet;

a waterway, the waterway operable to be substantially disposed in the shell, the waterway including a boost module and a mode module;

the boost module including a fixed boost sub-module and a movable boost sub-module;

the mode module including a fixed mode sub-module and a movable mode sub-module;

the fixed boost sub-module including an inlet region and a first flow passage, the inlet region operable to connect to a water hose, the first flow passage operable to fluidly communicate with the water hose;

the movable boost sub-module including a second flow passage, the second flow passage operable to fluidly communicate with the first flow passage;

the movable mode sub-module including a third flow passage and a plurality of flow openings, the third flow passage operable to fluidly communicate with the second flow passage, the plurality of flow openings operable to fluidly communicate with the third flow passage;

the fixed mode sub-module including a plurality of first outlet passages and a plurality of second outlet passages, the plurality of first outlet passages operable to fluidly communicate with the plurality of flow openings, the plurality of second outlet passages operable to fluidly communicate with the plurality of flow openings; and a face module, the face module including a first outlet and a second outlet, the first outlet operable to fluidly communicate with the plurality of first outlet passages and deliver water from the face module in a first form, the second outlet operable to fluidly communicate with the plurality of second outlet passages and deliver water from the face module in a second form;

wherein the movable boost sub-module is generally upstream of the movable mode sub-module;

wherein the movable boost sub-module is operable to move in a generally longitudinal direction with respect to a longitudinal axis of the shell;

wherein, when water is flowing to the wand, the boost module is operable to increase water flow from a non-boosted flow to a boosted flow; and wherein, when water stops flowing to the wand, the boost module is operable to return to a non-boosted flow position.

20. The wand of claim 19, wherein the non-boosted flow includes at least one of a normal flow and a low flow.

* * * * *